US010395911B2

(12) United States Patent
Cooks et al.

(10) Patent No.: US 10,395,911 B2
(45) **Date of Patent: *Aug. 27, 2019**

(54) SYSTEMS AND METHODS FOR RELAY IONIZATION

(71) Applicant: Purdue Research Foundation, West Lafayette, IN (US)

(72) Inventors: Robert Graham Cooks, West Lafayette, IN (US); Anyin Li, West Lafayette, IN (US); Adam Hollerbach, West Lafayette, IN (US)

(73) Assignee: Rudue Research Foundation, West Lafayette, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/265,514

(22) Filed: Feb. 1, 2019

(65) Prior Publication Data

US 2019/0180995 A1 Jun. 13, 2019

Related U.S. Application Data

(63) Continuation of application No. 15/556,401, filed as application No. PCT/US2016/021506 on Mar. 9, 2016, now Pat. No. 10,242,856.

(Continued)

(51) Int. Cl.

| | |
|---|---|
| ***H01J 49/00*** | (2006.01) |
| ***H01J 49/04*** | (2006.01) |
| ***H01J 49/16*** | (2006.01) |

(52) U.S. Cl.

CPC ..... *H01J 49/0409* (2013.01); *H01J 49/00* (2013.01); *H01J 49/04* (2013.01); *H01J 49/165* (2013.01); *H01J 49/167* (2013.01)

(58) Field of Classification Search

CPC ..... H01J 49/0409; H01J 49/00; H01J 49/04; H01J 49/165; H01J 49/167

See application file for complete search history.

(56) References Cited

U.S. PATENT DOCUMENTS

| | | | |
|---|---|---|---|
| 4,531,056 | A | 7/1985 | Labowsky et al. |
| 4,542,293 | A | 9/1985 | Fenn et al. |

(Continued)

FOREIGN PATENT DOCUMENTS

| | | | |
|---|---|---|---|
| WO | 2009/102766 | A1 | 8/2009 |
| WO | 2013/098616 | A1 | 7/2013 |

OTHER PUBLICATIONS

Ouyang, 2009, Miniature Mass Spectrometers, Ann. Rev. Anal. Chem., 2:187-214.

(Continued)

*Primary Examiner* — Nicole M Ippolito
*Assistant Examiner* — Sean M Luck
(74) *Attorney, Agent, or Firm* — Brown Rudnick LLP; Adam M. Schoen

(57) ABSTRACT

The invention generally relates to systems and methods for relay ionization of a sample. In certain aspects, the invention provides systems that include an ion source that generates ions, a sample emitter configured to hold a sample, and a mass spectrometer. The system is configured such that the ions generated by the ion source are directed to interact with the sample emitter, thereby causing the sample to be discharged from the sample emitter and into the mass spectrometer.

12 Claims, 18 Drawing Sheets

Related U.S. Application Data

(60) Provisional application No. 62/293,355, filed on Feb. 10, 2016, provisional application No. 62/130,154, filed on Mar. 9, 2015.

(56) References Cited

U.S. PATENT DOCUMENTS

| | | | | |
|---|---|---|---|---|
| 4,842,701 | A | 6/1989 | Smith et al. | |
| 4,861,988 | A | 8/1989 | Henion et al. | |
| 4,885,706 | A | 12/1989 | Pate et al. | |
| 5,068,535 | A | 11/1991 | Rabalais | |
| 6,297,499 | B1 | 10/2001 | Fenn | |
| 7,335,897 | B2 | 2/2008 | Takats et al. | |
| 8,304,718 | B2 | 11/2012 | Ouyang et al. | |
| 8,859,956 | B2 | 10/2014 | Ouyang et al. | |
| 9,064,674 | B2 | 6/2015 | Ouyang et al. | |
| 2005/0195393 | A1 | 9/2005 | Karanassios | |
| 2005/0230635 | A1* | 10/2005 | Takats | H01J 49/0404 250/424 |
| 2006/0108539 | A1* | 5/2006 | Franzen | G01N 27/68 250/423 P |
| 2008/0156985 | A1* | 7/2008 | Venter | H01J 49/142 250/288 |
| 2008/0277579 | A1 | 11/2008 | Lin et al. | |
| 2011/0042560 | A1 | 2/2011 | Ouyang et al. | |
| 2011/0147577 | A1 | 6/2011 | Kovtoun et al. | |
| 2012/0153141 | A1 | 6/2012 | Wouters et al. | |
| 2013/0284915 | A1* | 10/2013 | Shimada | H01J 49/0404 250/282 |
| 2013/0292565 | A1 | 11/2013 | Kalinitchenko | |
| 2014/0165701 | A1* | 6/2014 | Wu | G01N 27/62 73/23.38 |
| 2014/0264004 | A1 | 9/2014 | Cooks et al. | |
| 2015/0230738 | A1* | 8/2015 | Cooks | A61B 10/0045 600/352 |

OTHER PUBLICATIONS

Pozniak, 2007, Current Measurements within the Electrospray Emitter, J. Am. Soc. Mass Spectrom., vol. 18: pp. 737-748.
Sanders 2010, Hand-held mass spectrometer for environmentally relevant analytes using a variety of sampling and ionization methods, Euro. J. Mass Spectrom., vol. 16: pp. 11-20.
Santanilla, 2015, Nanomole-scale high-throughput chemistry for the synthesis of complex molecules, Science, vol. 347: pp. 49-53.
Shiea, 2005, Electrospray-assisted laser desorption/ionization mass spectrometry for direct ambient analysis of solids, J. Rapid Commun. Mass Spectrom., vol. 19: pp. 3701-3704.
Siffert, 1999, CD14 expression by human mononuclear phagocytes in modulated by Clostridium difficile toxin B, Microbes & Infection, vol. 1: pp. 1159-1162.
Skriba, 2014, Monitoring of Reaction Intermediates in the Gas Phase: Ruthenium-Catalyzed C-C Coupling, Organometallics, vol. 33: pp. 6868-6878.
Smith, 1990, New Developments in Biochemical Mass Spectrometry: Electrospray Ionization, Anal. Chem., vol. 62: pp. 882-899.
Stark, 2010, Characterization of dielectric barrier electrospray ionization for mass spectrometric detection, Anal. Bioanal. Chem., vol. 397: pp. 1767-1772.
Thompson, 1979, Field induced ion evaporation from liquid surfaces at atmospheric pressure, J. Chem. Phys., vol. 71: pp. 4451-4463.
Van Berkel, 2001, Electrochemical Process in a Wire-in-a Capillary Bulk-Loaded, Nano-Electrospray Emitter, J. Am. Soc. Mass Spectrom., vol. 12: pp. 853-862.
Wang, 2010, Paper Spray for Direct Analysis of Complex Mixtures Using Mass Spectrometry, Angew. Chem., vol. 122: pp. 889-892.
Wang, 2014, Interface solution isoelectric focusing with in situ MALDI-TOF mass spectrometry, Electrophoresis, vol. 35: pp. 2528-2533.
Wu, 2014, Efficient Separations of Intact Proteins Using Slip-Flow with Nano-Liquid Chromatography—Mass Spectrometry, Anal. Chem., vol. 86: pp. 1592-1598.
Xu, 2010, Miniaturization of Mass Spectrometry Analysis Systems, JALA, vol. 15: pp. 433-439.
Yamashita, 1984, Electrospray Ion Source. Another Variation on the Free-Jet Theme, J. Phys. Chem., vol. 88: pp. 4451-4459.
Yoon, 2012, Surface Acoustic Wave nebulization Facilitating Ipid Mass Spectrometric Analysis, Anal. Chem., vol. 84: pp. 6530-6537.
Yuill, 2013, Electrospray Ionization for Nanopipette Emitters with Tip Diameters of Less than 100 nm, Anal. Chem., vol. 85: pp. 8498-8502.
Zeleny, 1914, The Electrical Discharge From Liquid Points, and a Hydrostatic Method of Measuring the Electric Intensity at Their Surfaces, Physical Review, vol. 3: pp. 69-91.
Zhang, 2006, A novel cold plasma jet generated by atmospheric dielectric barrier capillary discharge, Thin Solid Films. pp. 506-507.
Zhao, 2002, Shiga-Like Toxin II Derived from *Escherichia coli* 0157:H7 Modifies Renal Handling of Levofloxacin in Rats, Antimicrobial Agents and Chemotherapy, vol. 46: pp. 1522-1528.
Zhao, 2014, Enhancement of the performance of organic solar cells by electrospray deposition with optimal solvent system, Solar Energy Matererials & Solar Cells, vol. 121: pp. 119-125.
Abe, 2008 Inkjet-Printed Microfluidic Multianalyte Chemical Sensing Paper, Anal. Chem., vol. 80: pp. 6928-6934.
Badu-Tawiah, 2012, Peptide Cross-Linking at Ambient Surfaces by Reactions of Nanosprayed Molecular Cations , Angew. Chem., 124: 9551-9555.
Bruzewicz, 2008, Low-Cost Printing of Poly(dimethylsiloxane) Barriers to Define Microschannels in Paper, Anal. Chem., vol. 80: pp. 3387-3392.
Buitrago, 2015, Nanomole-scale high-throughput chemistry for the synthesis of complex molecules, Science, 347:49-53.
Carroll, 1975, Atmospheric Pressure Ionization Mass Spectrometry: Corona Discharge Ion Source for Use in Liquid Chromatograph-Mass Spectrometer-Computer Analytical System, Anal. Chem., vol. 47: pp. 2369-2373.
Chen, 2006, Extractive electrospray ionization for direct analysis of undiluted urine, mile and other complex mixtures without sample preparation, Chem. Commun., pp. 2042-2044.
Cheng, 2009, Using Laser-Induced Acoustic Desorption/Electrospray Ionization Mass Spectrometry to Characterize Small Organic and Large Biological Compounds in the Solid State and in Solution Under Ambient Conditions, Anal. Chem., vol. 81: pp. 868-874.
Cody, 2005, Versatile New Ion Source for the Analysis of Materials in Open Air under Ambient Condition, Anal. Chem., vol. 77: pp. 2297-2302.
Dandavino, 2014, Microfabricated electrospray emitter arrays with integrated extractor and accelerator electrodes for the propulsion of small spacecraft, J. of Micromech. Microeng., vol. 24 075011.
Dole, 1968, Molecular Beams of Macroions, J. of Chem. Physics, vol. 49: pp. 2240-2249.
Dytrtova, 2013, In situ generation of copper cations and complexation with tebuconazole in a hyphenation of electrochemistry with mass spectrometry, Int. J. Mass Spectrom., vol. 338: pp. 45-49.
El-Faramawy, 2005, Efficiency of Nano-Electrospray Ionization, J Am Soc Mass Spectrom, vol. 16: pp. 1702-1707.
Fa, 2005, Profiling pH Gradients Across Nanocapillary Array Membranes Connecting Microfluidic Channels, J. Am. Chem. Soc., vol. 127: pp. 13928-13933.
Fenn, 1989, Electrospray Ionization for Mass Spectrometry of Large Biomolecules, Science, vol. 246: pp. 64-71.
Fico, 2007, Miniaturization and Geometry Optimization of a Polymer-Based Rectilinear Ion Trap, Anal. Chem., vol. 79: pp. 8076-8082.
Fisher, 2014, Affecting Protein Charge State Distributions in Nano-Electrospray Ionization via In-Spray Solution Mixing Using Theta Capillaries, Anal. Chem., vol. 86: pp. 4581-4588.
Gao,2006, Handheld Rectilinear Ion Trap Mass Spectrometer, Anal. Chem., vol. 78: pp. 5994-6002.
Guo, 2012, Microfluidic capture and release of bacteria in a conical nanopore array, Lab Chip, vol. 12: pp. 558-561.

(56) References Cited

OTHER PUBLICATIONS

Hand, 1989, Enhanced Silver Cationization of Polycyclic Aromatic Hydrobarbons Containing Bay Regions in Molecular Secondary Ion Mass Spectrometry, Biomed. Environ. Mass Spectrom., vol. 18: pp. 83-85.
Ho, 2011, Paper-Based Microfluidic Surface Acoustic Wave Sample Delivery and Ionization Source for Rapid and Sensitive Ambient Mass Spectrometry, Anal. Chem., vol. 83: pp. 3260-3266.
Hu, 2011, Electrospray Ionization Using Wooden Tips, Anal. Chem., vol. 83: pp. 8201-8207.
International Preliminary Report on Patentability dated Sep. 12, 2017 in PCT/US2016/021506, 9 pages.
International Search Report and Written Opinion dated May 17, 2016 in PCT/US2016/021506, 12 pages.
Iribarne, 1976, On the evaporation of small ions from charged droplets, J. Chem. Phys., vol. 64: pp. 2287-2289.
Jackson, 2011, Enhanced detection of olefins using ambient ionization mass spectrometry: Ag+ adducts of biologically relevant alkenes, Anal. Bioanal. Chem. vol. 399: pp. 367-376.
Jjunju, 2013, In Situ Analysis of Corrosion Inhibitors Using a Portable Mass Spectrometer with Paper Spray Ionization, Analyst, vol. 138: pp. 3740-3748.
Jjunju, 2014, Analysis of Polycyclic Aromatic Hydrocarbons Using Desorption Atmospheric Pressure Chemical Ionization Coupled to a Portable Mass Spectrometer, J. Am. Soc. Mass Spectrom., vol. 26: pp. 271-280.
Johnson, 2011, Soft Landing of Complex Molecules on Surfaces, J. Annu. Rev. Anal. Chem., 4(1):83-104.
Karas, 2000, Nano-electrospray ionization mass spectrometry: addressing analytical problems beyond routine, Fresenius J Anal Chem., vol. 366: pp. 669-676.
Kogelschatz, 2003, Dielectric-barrier Discharges: Their History, Discharge Physics, and Industrial Applications, Plasma Chem. and Plasma Processing, vol. 23: pp. 1-46.
Kriger,1995, Durable Gold-Coated Fused Silica Capillaries for Use in Electrospray Mass Spectrometry, Anal. Chem., vol. 67: pp. 385-389.
Lafreniere, 2014,I Multiplexed extraction and quantitative analysis of pharmaceuticals from DBS samples using digital microfluidics, Bioanalysis, vol. 6(3): pp. 307-318.
Lapainis, 2009, Capillary Electrophoresis with Electrospray Ionization Mass Spectrometric Detection for Single-Cell Metabolomics, Anal. Chem., vol. 81: pp. 5858-5864.
Laroussi, 2007, Arc-Free Atmospheric Pressure Cold Plasma Jets: A Review, Plasma Process. Polym. 2007, vol. 4: pp. 777-788.
Li, 2008, Paper-Based Microfluidic Devices by Plasma Treatment, Anal. Chem, vol. 80: pp. 9131-9134.
Li, 2011, Paper spray ionization of polar analytes using non-polar solvents, Chem. Commun., vol. 47: pp. 2811-2813.
Li, 2013, Direct analysis of 4-methylimidazole in foods using paper spray mass spectrometry, Analyst, vol. 138: pp. 4624-4630.
Li, 2013, Nucleophilic Addition of Nitrogen to Aryl Cations: Mimicking Titan Chemistry, J. Am. Soc. Mass Spectrom., vol. 24: pp. 1745-1754.
Li, 2014, Synthesis and Catalytic Reactions of Nanoparticles formed by Electrospray Ionization of Coinage Metals, Angew. Chem., Int. Ed., vol. 53: pp. 3147-3150.
Li 2014, Using Ambient Ion Beams to Write Nanostructured Patterns for Surface Enhanced Raman Spectroscopy, Angew. Chem., Int. Ed., vol. 53: pp. 12528-12531.
Mack, 1970, Molecular Beams fo Macroions. II, J. Chem. Physics, vol. 52, No. 10, pp. 4977-4986.
Martinez, 2007, Patterned Paper as a Platform for Inexpensive, Low-Volume, Portable Bioassays, Angew. Chem. Int. Ed., vol. 46: pp. 1318-1320.
Martinez, 2008, FLASH: A rapid method for prototyping paper-based microfluidic devices, Lab Chip, vol. 8: pp. 2146-2150.
Martinez, 2008, Three-dimensional microfluidic devices fabricated in layered paper and tape, Proc. Nat'l. Acad. Sci. USA, vol. 105: pp. 19606-19611.
Mizuno, 2008, Live single-cell video-mass spectrometry for cellular and subcellullar molecular detection and cell classigication, J. Mass Spectrom., vol. 43: pp. 1692-1700.
Mortensen, 2014, Theta-Glass Capillaries in Electrospray Ionization: Rapid Mixing and Short Droplet Lifetimes, Anal. Chem. 2014, vol. 86: pp. 9315-9321.
Mulligan, 2006, Desorption electrospray ionization with a portable mass spectrometer: in situ analysis of ambient surfaces, Chem. Comm., 1709-1711.
Mulligan, 2006, Direct monitoring of toxis compounds in air using a portable mass spectrometer, The Analyst, vol. 131: pp. 556-567.
Nemes, 2007, Laser Ablation Electrospray Ionization for Atmospheric Pressure, in Vivo, and Imaging Mass Spectrometry, Anal. Chem., vol. 79: pp. 8098-8106.
Ouyang, 2009, Handheld Miniature Ion Trap Mass Spectrometers, Anal. Chem., vol. 81: pp. 2421-2425.

* cited by examiner

SYSTEMS AND METHODS FOR RELAY IONIZATION

RELATED APPLICATIONS

The present invention is a continuation of U.S. nonprovisional patent application Ser. No. 15/556,401, filed Sep. 7, 2017, which is a 35 U.S.C. § 371 national phase application of PCT/US16/21506, filed Mar. 9, 2016, which claims the benefit of and priority to each of U.S. provisional patent application No. 62/130,154, filed Mar. 9, 2015 and U.S. provisional patent application No. 62/293,355, filed Feb. 10, 2016, the content of each of which is incorporated by reference herein in its entirety.

GOVERNMENT SUPPORT

This invention was made with government support under DE-FG02-06ER15807 awarded by the Department of Energy. The government has certain rights in the invention.

FIELD OF THE INVENTION

The invention generally relates to systems and methods for relay ionization of a sample.

BACKGROUND

Electrospray ionization (ESI) is a technique used in mass spectrometry to produce ions using an electrospray in which a high voltage is applied to a liquid to create an aerosol. It is especially useful in producing ions from macromolecules because it overcomes the propensity of these molecules to fragment when ionized. ESI has important applications in mass spectrometry, propulsion, and materials fabrication.

As mentioned above, in ESI, electrical contact with a voltage supply is necessary to generate a continuous spray of charged droplets from a sample solution. The electrical contact adds dead volume and adsorption surfaces, requiring cleaning to eliminate sample carryover. Electrical contact also complicates the apparatus configuration, especially for arrays of ESI emitters.

SUMMARY

The invention provides a non-contact technique for producing an electrospray. Aspects of the invention are accomplished using two emitters, in which a first emitter relays ions onto a second emitter to produce an electrospray of a sample from the second emitter (relay electrospray ionization). Particularly, the first emitter deposits charge (ions) onto or into a second emitter loaded with sample solution. The impinging ions (e.g., generated by a primary electrospray or plasma ionization source) pass charge to the electrically floated sample loading second emitter, causing an immediate electrospray to occur from the tip of the secondary emitter.

In certain aspects, the invention provides systems that include an ion source that generates ions, a sample emitter configured to hold a sample, and a mass spectrometer (e.g., bench-top or miniature mass spectrometer). The system is configured such that the ions generated by the ion source are directed to interact with the sample emitter in order to cause the sample to be discharged from the sample emitter and into the mass spectrometer. Systems of the invention allow for high throughput sample analysis, in which a plurality of samples may be prepared and tested one after the other without a need for cleaning or decontaminating an electrode in between testing.

Other aspects of the invention provide methods for analyzing a sample. The methods may involve generating ions from an ion source, directing the ions to interact with a sample emitter including a sample in order to cause the sample to be discharged from the sample emitter, and analyzing the discharged sample in a mass spectrometer (e.g., bench-top or miniature mass spectrometer). Methods of the invention can analyze any type of sample, such as biological samples, environmental samples, or agricultural samples.

Numerous different types of sample emitters can be used with the systems and methods of the invention. An exemplary sample emitter is a hollow body configured such that the sample is held within the hollow body. In certain embodiments, a proximal portion of the hollow body is open ended and the ions from the ion source are directed to interact with and enter a proximal end of the hollow body, thereby causing the sample to be discharged from a distal end of the sample emitter and into the mass spectrometer. In other embodiments, a proximal portion of the hollow body is sealed and the ions from the ion source are directed to interact with the proximal end of the hollow body, thereby causing the sample to be discharged from a distal end of the sample emitter and into the mass spectrometer.

Another exemplary sample emitter is a solid body (i.e., without a hollow core or bore or being solid throughout) and the sample is held on an exterior portion of the solid body. In such an embodiment, the system is configured such that the ions from the ion source are directed to interact with a proximal end of the solid body, thereby causing the sample to be discharged from a distal end of the sample emitter and into the mass spectrometer.

Other exemplary sample emitters include a hollow capillary in which a proximal and distal end are open, a hollow capillary in which a proximal end is sealed and a distal end is open, a steel needle including an inner bore, a solid steel needle, a porous material (such as described in U.S. Pat. No. 8,859,956, the content of which is incorporated by reference herein in its entirety), or any combination thereof.

Numerous different types of ion sources can be used with the systems and methods of the invention. An exemplary ion source is an electrospray source. Another exemplary ion source is a plasma discharge source.

BRIEF DESCRIPTION OF THE DRAWINGS

FIG. 4 panel B shows rESI current through three positive and two negative cycles. FIG. 4 panel C shows electrical operating schematic. FIG. 4 panel D is a photograph of a relay spray plume.

FIG. 8 panel B is a photograph showing that relay electrosprays could be generated from the distal end of capillaries even when the sealed capillary's outer wall was partially grounded using a copper tape. FIG. 8 panel C is a photograph showing that relay electrosprays could be generated from the distal end of capillaries even when the capillary's outer wall was sputter coated with ~5 nm Au/Pd. FIG. 8 panel D is a photograph showing that only when this coated outer wall was grounded could the relay spray be avoided.

(FIG. 10 panel B) sharp end of a wooden pick; (FIG. 10 panel C) pulled theta shaped tip and (FIG. 10 panel D) filter paper triangle.

FIG. 17 panels C-D show array of emitters (FIG. 17 panel C) before and (FIG. 17 panel D) upon simultaneous triggering of all 11 emitters in the array.

DETAILED DESCRIPTION

Figure 1:
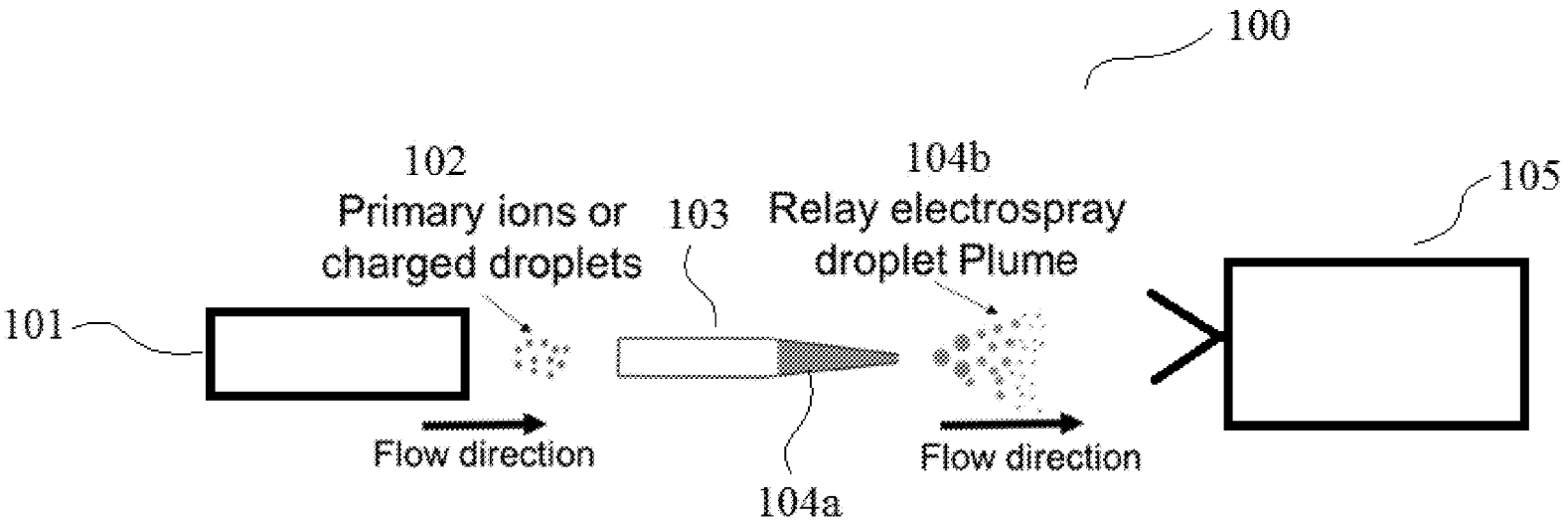
FIG. 1 shows an embodiment of an exemplary system of the invention.

The invention generally relates to systems and methods for relay ionization of a sample. FIG. 1 shows an embodiment of an exemplary system 100 of the invention. The system 100 include an ion source 101 that generates ions 102, a sample emitter 103 configured to hold a sample 104*a*, and a mass spectrometer 105. The system 100 is configured such that the ions 102 generated by the ion source 101 are directed to interact with the sample emitter 103, thereby causing the sample 104*a* to be discharged (discharge 104*b*) from the sample emitter 103 and into the mass spectrometer 105. The set-up shown in FIG. 1 is exemplary and the skilled artisan will appreciate that variations of the set-up shown in FIG. 1 are within the scope of the invention. For example, FIG. 1 illustrates ion source 101 generating ions 102 that impinge on a proximal end of sample emitter 103. Other configurations are possible, such ion source 101 generating ions 102 that impinge on a top or bottom side of sample emitter 103. The ions 102 generated by ion source 101 may be positive ions or negative ions or a combination thereof.

Numerous different types of ion sources 101 can be used with the systems and methods of the invention. Exemplary ion sources 101 include electrospray ionization (ESI; Fenn et al., Science, 246:64-71, 1989; and Yamashita et al., J. Phys. Chem., 88:4451-4459, 1984); atmospheric pressure ionization (APCI; Carroll et al., Anal. Chem. 47:2369-2373, 1975); desorption electrospray ionization (DESI; Takats et al., Science, 306:471-473, 2004 and U.S. Pat. No. 7,335,897); direct analysis in real time (DART; Cody et al., Anal. Chem., 77:2297-2302, 2005); Atmospheric Pressure Dielectric Barrier Discharge Ionization (DBDI; Kogelschatz, Plasma Chemistry and Plasma Processing, 23:1-46, 2003, and PCT international publication number WO 2009/102766), and electrospray-assisted laser desoption/ionization (ELDI; Shiea et al., J. Rapid Communications in Mass Spectrometry, 19:3701-3704, 2005). The content of each reference is incorporated herein in its entirety.

In certain embodiments, the ion source 101 is an electrospray source. Electrospray ionization probes and devices are described for example in Fenn et al. (U.S. Pat. No. 6,297,499), Labowsky et al. (U.S. Pat. No. 4,531,056), Yamashita et al (U.S. Pat. No. 4,542,293), Henion et al. (U.S. Pat. No. 4,861,988), Smith et al, (U.S. Pat. Nos. 4,842,701 and 4,885,706), Fenn et al. (Science 246, 64 (1989)), Fenn et al. (Mass Spectrometry Reviews 6, 37 (1990)), and Smith et al. (Analytical Chemistry 2, 882 (1990)), the content of each of which is incorporated by reference herein in its entirety. Electrospray probes are commercially available from Thermo Fischer Scientific.

Typically in an electrospray device, a solution at a few microliters/minute (uL/min) is injected through a hypodermic needle into an opposing flow of a bath or drying gas (e.g. a few L/min of warm dry nitrogen) in an electrospray chamber whose walls serve as a cylindrical electrode and whose pressure is typically maintained at or near one atmosphere. In the end wall of the chamber is a glass capillary tube with typical dimensions in mm of: L=180, OD=6, and ID=0.6. The front face of the glass capillary tube is metalized and held at a few kV "below" the potential of the injection needle, which can be at any desired potential including ground. The cylindrical electrode (spray chamber) is at a potential intermediate between that of the injection needle and metallized face of the glass tube. The resulting electric field at the tip of the needle disperses the emerging liquid into a fine spray of charged droplets. Driven by the field, the droplets shrink as they evaporate solvent into the opposing flow of the drying gas. This shrinking increases each droplet's surface charge density until the so-called Rayleigh limit is reached at which electrostatic repulsion overcomes surface tension and a "Coulomb explosion" disperses the droplet into a plurality of smaller droplets which repeat the sequence of evaporation and explosion. Then the droplets become small enough that a charge density below the Rayleigh limit can produce an electric field normal to the droplet surface that is strong enough to evaporate or desorb solute surface ions into the ambient bath gas. This Ion Desorption Mechanism, proposed by Iribarne and Thomson [J. Chem. Phys. 64, 2287 (1976) and 71, 4451 (1979)] is now accepted by many investigators.

Others favor a Charged Residue Mechanism (CRM) proposed by Malcolm Dole and his colleagues [J. Chem. Phys. 49, 2240 (1968) and 52, 4977 (1970)]. It assumes that the evaporation-explosion sequence leads to ultimate droplets so small that each one contains only a single solute molecule that becomes an ion by retaining some of that ultimate droplet's charge as the last solvent evaporates. By whatever mechanism they may be formed, the ions along with the evaporating droplets drift down the field, counter-current to the flow of drying gas to arrive at a the sample emitter 103. In certain electrospray approaches, the need for counter-current gas flow is avoided, and most of the desolvation of droplets and ions is achieved by raising the temperature of the mixture of droplets, ions, and bath gas, or a portion thereof.

In other embodiments, the ion source 101 is a plasma discharge source. An exemplary plasma discharge source is a piezoelectric direct discharge plasma generator. A piezoelectric direct discharge plasma generator is a type of a cold (nonequilibrium) plasma generator that can efficiently ionize different process gases including air in a wide pressure range. Nonequilibrium plasma (cold plasma) can be generated under atmospheric conditions at very high frequencies or using short duration microdischarges created by dielectric breakdown between two electrodes separated by an insulating dielectric barrier. The so-called "cold discharge" or dielectric barrier discharge (DBD) is used in many applications where high temperatures have to be avoided.

The basic concept of the piezoelectric direct discharge technology (PDD) is to use a piezoelectric transformer (PT) as an integral part of the plasma source. Thus, all high voltage problems of traditional atmospheric plasma sources can be avoided. Both plasma microjets and surface discharge plasma devices of the corona type can be built.

Plasma sources are described for example in Ouyang et al. (U.S. Pat. No. 9,064,674), Zhang (Thin Solid Films, 506-507:404-408, 2006), Laroussi (Plasma Process. Polym., 4:777-788, 2008), and Lin (U.S. patent application publication number 2008/0277579), the content of each of which is incorporated by reference herein in its entirety.

Low temperature plasma (LTP) probes are also described in Ouyang et al. (U.S. patent application Ser. No. 12/863,801 and PCT application number PCT/US09/33760), the content of each of which is incorporated by reference herein in its entirety. Unlike electrospray or laser based ambient ionization sources, plasma sources do not require an electrospray solvent, auxiliary gases, and lasers. LTP can be characterized as a non-equilibrium plasma having high energy electrons, with relatively low kinetic energy but reactive ions and neutrals; the result is a low temperature ambient plasma that can be used to desorb and ionize analytes from surfaces and produce molecular ions or fragment ions of the analytes. A distinguishing characteristic of the LTP, in comparison with high temperature (equilibrium) plasmas, is that the LTP does not breakdown the molecules into atoms or small molecular fragments, so the molecular information is retained in the ions produced. LTP ionization sources have the potential to be small in size, consume low power and gas (or to use only ambient air) and these advantages can lead to reduced operating costs. In addition to cost savings, LTP based ionization methods have the potential to be utilized with portable mass spectrometers for real-time analytical analysis in the field (Gao, L.; Song, Q.; Patterson, G. E.; Cooks, D. Ouyang, Z., Anal. Chem. 2006, 78, 5994-6002; Mulligan, C. C.; Talaty, N.; Cooks, R. G., Chemical Communications 2006, 1709-1711; and Mulligan, C. C.; Justes, D. R.; Noll, R. J.; Sanders, N. L.; Laughlin, B. C.; Cooks, R. G., The Analyst 2006, 131, 556-567).

Figure 2:
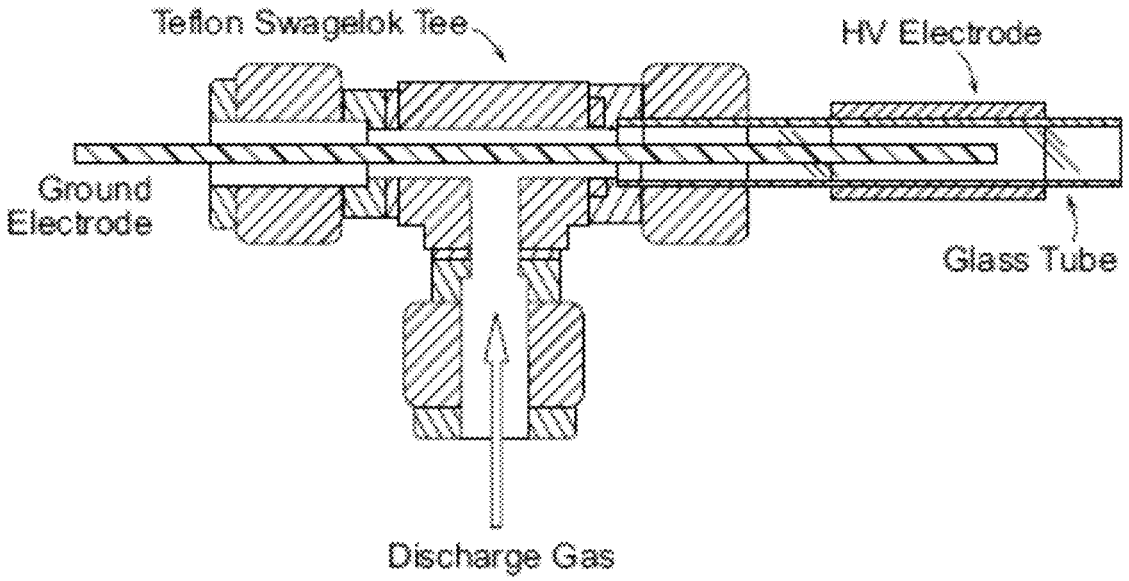
FIG. 2 shown an exemplary ion source, a low temperature plasma probe.

An exemplary LTP probe is shown in FIG. 2. Such a probe may include a housing having a discharge gas inlet port, a probe tip, two electrodes, and a dielectric barrier, in which the two electrodes are separated by the dielectric barrier, and in which application of voltage from a power supply generates an electric field and a low temperature plasma, in which the electric field, or gas flow, or both, propel the low temperature plasma out of the probe tip. The ionization source of the probe described herein is based upon a dielectric barrier discharge (DBD; Kogelschatz, U., Plasma Chemistry and Plasma Processing 2003, 23, 1-46). Dielectric barrier discharge is achieved by applying a high voltage signal, for example an alternating current, between two electrodes separated by a dielectric barrier. A non-thermal, low power, plasma is created between the two electrodes, with the dielectric limiting the displacement current. This plasma contains reactive ions, electrons, radicals, excited neutrals, and metastable species in the ambient environment of the sample which can be used to desorb/ionize molecules from a solid sample surface as well as ionizing liquids and gases. The plasma can be extracted from the discharge region and directed toward the sample surface with the force by electric field, or the combined force of the electric field and gas flow.

In certain embodiments, the probe further includes a power supply. The power supply can provide direct current or alternating current. In certain embodiments, the power supply provides an alternating current. In certain embodiments, a discharge gas is supplied to the probe through the discharge gas inlet port, and the electric field and/or the discharge gas propel the low temperature plasma out of the probe tip. The discharge gas can be any gas. Exemplary discharge gases include helium, compressed or ambient air, nitrogen, and argon. In certain embodiments, the dielectric barrier is composed of an electrically insulating material. Exemplary electrically insulating materials include glass, quartz, ceramics and polymers. In other embodiments, the dielectric barrier is a glass tube that is open at each end. In other embodiments, varying the electric field adjusts the energy and fragmentation degree of ions generated from the analytes in a sample.

In other embodiments, the ion source 101 is a wetted porous material, as described in greater detail below or in Ouyang et al. (U.S. Pat. No. 8,859,956), the content of which is incorporated by reference herein in its entirety.

In certain embodiments, the ion source 101 comes in contact with a solution to generate an ion spray plume or also referred to as an on-demand ionization spray. The solution may be a water and methanol mixture, acetonitrile, or any other well-known ion spray solution. The solution used to generate the ion spray plume from the ion source 101 may be specifically chosen based on the sample 104*a* loaded in the sample emitter 103. The solution may be used solely to generate ions, or it may be chosen to produce ions and cause a reaction with the sample 104*a* loaded in the sample emitter 103. Those skilled in the art will recognize that the solution will be based on the sample and application of use. For example silver ions generated by electrolytic spray ionization may be injected into an olefin sample solution to generate $Ag^+$ cationized species, which are suitable for mass spectrometry analysis.

The system 100 is configured such that the ions 102 generated by the ion source 101 are directed to interact with the sample emitter 103, thereby causing the sample 104*a* to be discharged (discharge 104*b*) from the sample emitter 103 and into the mass spectrometer 105. Numerous different types of sample emitters 103 can be used with the systems and methods of the invention. Exemplary sample emitters include a hollow capillary in which a proximal and distal end are open, a hollow capillary in which a proximal end is sealed and a distal end is open, a steel needle including an inner bore, a solid steel needle, a porous material (such as described in U.S. Pat. No. 8,859,956, the content of which is incorporated by reference herein in its entirety), or any combination thereof.

In certain embodiments, the sample emitter 103 is a hollow body that can have a distal tip for ejecting a spray of the sample 104*a* that is loaded into the sample emitter 103. An exemplary hollow body is a nano-ESI probe capillary with a distal tip. Exemplary nano-ESI probes are described for example in each of Karas et al. (Fresenius J Anal Chem. 366(6-7):669-76, 2000) and El-Faramawy et al. (J Am Soc Mass Spectrom, 16:1702-1707, 2005), the content of each of which is incorporated by reference herein in its entirety. Nano-ESI needles are commercially available from Proxeon Biosystems (Odense, Denmark) and New Objective Inc (Woburn, Mass.). In other embodiments, the system may include a sample cartridge containing one or more spray tips and one or more electrodes. Another exemplary hollow body is a glass borosilicate, quartz, or fused silica capillary with a pulled tip. The tip will typically have a diameter from about 2 μm to about 50 μm. Another exemplary hollow body is a metal needle (e.g., steel needle) with a hollow bore.

In such embodiments, the sample 104*a* is loaded within a distal end of the hollow body. The proximal end of the hollow body receives the impinging ions 102 from the ion source 101. The proximal end of the hollow body may be open ended or sealed.

In other embodiments, the sample emitter 103 is a solid (i.e., not hollow) body, such as a solid metal needle. Exemplary solid body emitters are described foe example in Ouyang (U.S. patent application publication number 2014/0264004), the content of which is incorporated by reference herein in its entirety. One suitable probe is a teasing needle; these are metallic, possess a sharp tip, and are optionally roughened. The metallic and roughened features appear to be beneficial when sampling and transferring material, such as biological tissue. The crevasses in the roughened surface hold material during sample transfer and analysis, facilitating analyte extraction. In addition, in the case of teasing needles, the angled feature was found to increase reliability, as it accommodated solvent application and was observed to promote solvent flow. In certain embodiments, complete wetting of the probe's surface improved extraction of analytes and emission of solvent microdroplets.

In certain embodiments, at least the tips of the probes of the invention are non-porous. Non-porous refers to materials that do not include through-holes that allow liquid or gas to pass through the material, exiting the other opposite side. Exemplary, non-porous materials include but are not limited to metal or plastics. An exemplary porous material is paper.

Non-porous probes of the invention can include a roughened tip. The roughening can be crevasses, grooves, indentations, etc., that allow material to collect within. The roughened surface does not make the non-porous material porous. Rather it provides portions of the surface in which sample material can collect. The collected sample material does not enter or pass-through the remainder of the probe tip once collected in such features. Accordingly, non-porous material that includes crevasses, grooves, indentations, etc. is still considered non-porous material for purposes of the invention. For example, a metal probe tip that includes crevasses, grooves, indentations, etc. is a tip of a probe that comprises non-porous material.

In such embodiments, the sample 104*a* is loaded onto an exterior of a distal end of the solid body. The proximal end of the hollow body receives the impinging ions 102 from the ion source 101.

In other embodiments, the sample emitter 103 is a porous material, optionally a wetted porous material. Probes comprised of porous material that is wetted to produce ions are described in Ouyang et al. (U.S. Pat. No. 8,859,956), the content of which is incorporated by reference herein in its entirety. Porous materials, such as paper (e.g. filter paper or chromatographic paper) or other similar materials are used to hold and transfer liquids and solids, and ions are generated directly from the edges of the material when an electric field is applied to the material. The porous material may be kept discrete (i.e., separate or disconnected) from a flow of solvent, such as a continuous flow of solvent. Instead, sample is either spotted onto the porous material or swabbed onto it from a surface including the sample. The spotted or swabbed sample the receives the ions 102 from the ion source 101 to produce ions 104*b* of the sample 104*a* which are subsequently mass analyzed. The sample 104*a* is transported through the porous material without the need of a separate solvent flow. Pneumatic assistance is not required to transport the analyte; rather, a charge is simply applied to the porous material that is held in front of a mass spectrometer 105.

In certain embodiments, the porous material is any cellulose-based material. In other embodiments, the porous material is a non-metallic porous material, such as cotton, linen wool, synthetic textiles, or plant tissue. In still other embodiments, the porous material is paper. Advantages of paper include: cost (paper is inexpensive); it is fully commercialized and its physical and chemical properties can be adjusted; it can filter particulates (cells and dusts) from liquid samples; it is easily shaped (e.g., easy to cut, tear, or fold); liquids flow in it under capillary action (e.g., without external pumping and/or a power supply); and it is disposable.

In certain embodiments, the porous material is integrated with a solid tip having a macroscopic angle that is optimized for spray. In these embodiments, the porous material is used for filtration, pre-concentration, and wicking of the solvent containing the analytes for spray at the solid type.

In particular embodiments, the porous material is filter paper. Exemplary filter papers include cellulose filter paper, ashless filter paper, nitrocellulose paper, glass microfiber filter paper, and polyethylene paper. Filter paper having any pore size may be used. Exemplary pore sizes include Grade 1 (11 μm), Grade 2 (8 μm), Grade 595 (4-7 μm), and Grade 6 (3 μm). Pore size will not only influence the transport of liquid inside the spray materials, but could also affect the formation of the Taylor cone at the tip. The optimum pore size will generate a stable Taylor cone and reduce liquid evaporation. The pore size of the filter paper is also an important parameter in filtration, i.e., the paper acts as an online pretreatment device. Commercially available ultra filtration membranes of regenerated cellulose, with pore sizes in the low nm range, are designed to retain particles as small as 1000 Da. Ultra filtration membranes can be commercially obtained with molecular weight cutoffs ranging from 1000 Da to 100,000 Da.

Probes of the invention work well for the generation of micron scale droplets simply based on using the charge generated at an edge of the porous material. In particular embodiments, the porous material is shaped to have a macroscopically sharp point, such as a point of a triangle, for ion generation. Probes of the invention may have different tip widths. In certain embodiments, the probe tip width is at least about 5 μm or wider, at least about 10 μm or wider, at least about 50 μm or wider, at least about 150 μm or wider, at least about 250 μm or wider, at least about 350 μm or wider, at least about 400μ or wider, at least about 450 μm or wider, etc. In particular embodiments, the tip width is at least 350 μm or wider. In other embodiments, the probe tip width is about 400 μm. In other embodiments, probes of the invention have a three dimensional shape, such as a conical shape.

As mentioned above, no pneumatic assistance is required to transport the droplets. Ambient ionization of analytes is realized on the basis of these charged droplets, offering a simple and convenient approach for mass analysis of solution-phase samples. Sample solution is directly applied on the porous material held in front of an inlet of a mass spectrometer without any pretreatment. Then the ambient ionization is performed by applying charge on the wetted porous material. In certain embodiments, the porous material is paper, which is a type of porous material that contains numerical pores and microchannels for liquid transport. The pores and microchannels also allow the paper to act as a filter device, which is beneficial for analyzing physically dirty or contaminated samples. In other embodiments, the porous material is treated to produce microchannels in the porous material or to enhance the properties of the material for use as a probe of the invention. For example, paper may undergo a patterned silanization process to produce microchannels or structures on the paper. Such processes involve, for example, exposing the surface of the paper to tridecafluoro-1,1,2,2-tetrahydrooctyl-1-trichlorosilane to result in silanization of the paper.

In other embodiments, a soft lithography process is used to produce microchannels in the porous material or to enhance the properties of the material for use as a probe of the invention. In other embodiments, hydrophobic trapping regions are created in the paper to pre-concentrate less hydrophilic compounds. Hydrophobic regions may be patterned onto paper by using photolithography, printing methods or plasma treatment to define hydrophilic channels with lateral features of 200-1000 μm. See Martinez et al. (Angew. Chem. Int. Ed. 2007, 46, 1318-1320); Martinez et al. (Proc. Natl Acad. Sci. USA 2008, 105, 19606-19611); Abe et al. (Anal. Chem. 2008, 80, 6928-6934); Bruzewicz et al. (Anal. Chem. 2008, 80, 3387-3392); Martinez et al. (Lab Chip 2008, 8, 2146-2150); and Li et al. (Anal. Chem. 2008, 80, 9131-9134), the content of each of which is incorporated by reference herein in its entirety. Liquid samples loaded onto such a paper-based device can travel along the hydrophilic channels driven by capillary action.

The sample ions or charged droplets 104*b* are analyzed by a mass spectrometer 105. Any type of mass spectrometer may be used to analyze the sample ions or charged droplets 104*b*. In certain embodiments, the mass spectrometer is a standard commercial bench-top mass spectrometer. In other embodiments, the mass spectrometer is a miniature mass spectrometer. An exemplary miniature mass spectrometer is described, for example in Gao et al. (Z. Anal. Chem. 2006, 78, 5994-6002), the content of which is incorporated by reference herein in its entirety In comparison with the pumping system used for lab-scale instruments with thousands watts of power, miniature mass spectrometers generally have smaller pumping systems, such as a 18 W pumping system with only a 5 L/min (0.3 m3/hr) diaphragm pump and a 11 L/s turbo pump for the system described in Gao et al. Other exemplary miniature mass spectrometers are described for example in Gao et al. (Anal. Chem., 80:7198-7205, 2008), Hou et al. (Anal. Chem., 83:1857-1861, 2011), and Sokol et al. (Int. J. Mass Spectrom., 2011, 306, 187-195), the content of each of which is incorporated herein by reference in its entirety. Miniature mass spectrometers are also described, for example in Xu et al. (JALA, 2010, 15, 433-439); Ouyang et al. (Anal. Chem., 2009, 81, 2421-2425); Ouyang et al. (Ann. Rev. Anal. Chem., 2009, 2, 187-214); Sanders et al. (Euro. J. Mass Spectrom., 2009, 16, 11-20); Gao et al. (Anal. Chem., 2006, 78(17), 5994-6002); Mulligan et al. (Chem. Com., 2006, 1709-1711); and Fico et al. (Anal. Chem., 2007, 79, 8076-8082).), the content of each of which is incorporated herein by reference in its entirety.

In certain embodiments, systems of the invention are equipped with a discontinuous interface, which is particularly useful with miniature mass spectrometers. An exemplary discontinuous interface is described for example in Ouyang et al. (U.S. Pat. No. 8,304,718), the content of which is incorporated by reference herein in its entirety.

In certain embodiments, systems and methods of the invention utilize more than one relay ion source 101. For example, systems and methods of the invention can be configured such that a primary ion source generates ions that impinge on a secondary ion source, causing the production of ions from the secondary ion source that impinge on the sample emitter. The systems and methods of the invention are not limited to any particular number of ion sources, so long as ion transfer is permitted. For examples, the invention contemplates using one, two, three, four, five, six, seven, eight, nine, or ten ion sources, arranged in series.

In other embodiments, the invention provides arrayed systems and methods. Such systems and methods use a plurality of sample emitters and one or more ion sources. The arrays can be configured such that a single ion source impinges ions onto a plurality of sample emitters, causing simultaneous discharge of sample from each emitter. Alternatively, a single ion source impinges ions onto a plurality of sample emitters, one at a time, causing triggering of individual sample emitters in a timed manner. In another embodiment, more than one ion source is used with a plurality of sample emitters to cause timed or simultaneous discharge of sample from some or all of the sample emitters. Such embodiments allow for multiple use of spray ionization without contamination of an electrode. The arrays also allow for high throughput of sample analysis, where a plurality of samples may be prepared and tested one after the other without a need for cleaning or decontaminating in between testing.

In such embodiment, the one or more ion sources and/or the plurality of spray emitters may be operably coupled to a device that is able to move the one or more ion sources and/or the plurality of spray emitters to various locations, within a three-dimensional (3D) plane, such as a moving stage.

Systems and methods of the invention can analyze any type of sample. The sample may be in the form of a solid, liquid, or gas. In certain embodiments, the sample is a biological sample. Exemplary biological samples include tissue (e.g., human or mammal), or body fluid. Generally, a body fluid refers to a liquid material derived from, for example, a human or other mammal. Such body fluids include, but are not limited to, mucus, blood, plasma, serum, serum derivatives, bile, phlegm, saliva, sweat, amniotic fluid, mammary fluid, urine, sputum, and cerebrospinal fluid (CSF), such as lumbar or ventricular CSF. A body fluid may also be a fine needle aspirate. A body fluid also may be media containing cells or biological material. Samples can also be environmental samples, such as river water, soil, etc.

In addition to native components of the sample, the biological or environmental samples can include a non-native biological agent that can be analyzed by methods of the invention. In certain embodiments, a biological agent include all genuses and species of bacteria and fungi, including, for example, all spherical, rod-shaped and spiral bacteria. Exemplary bacteria are stapylococci (e.g., *Staphylococcus epidermidis* and *Staphylococcus aureus*), *Enterrococcus faecalis, Pseudomonas aeruginosa, Escherichia coli*, other gram-positive bacteria, and gram-negative bacilli. An exemplary fungus is *Candida albicans*. A biological agent also includes toxins secreted by bacteria or fungi. For example, *E. coli* secretes Shiga-like toxin (Zhao et al., Antimicrobial Agents and Chemotherapy, 1522-1528, 2002) and *C. Difficile* secretes Exotoxin B (Sifferta et al. Microbes & Infection, 1159-1162, 1999). A biological agent can also include an allergen. An allergen is a nonparasitic antigen capable of stimulating an immune response in a subject. Allergens can include plant pollen or dust mite excretion.

In other embodiments, the sample comprises a small molecule, peptides, vitamins, RNA, lipids, DNA, proteins, biomolecules, synthetic molecules, illicit substances, pesticides, or the like.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

EXAMPLES

Relay electrospray spray (rESI) from the distal end of a capillary containing a sample (or array of capillaries) involves primary ion (or charged droplet) deposition into the sample solution or onto the capillary from the proximal end. The primary ions (or charged droplets) may be produced by a primary electrospray ionization source, a plasma ion source, or a handheld piezoelectric direct discharge plasma ion source. Without any physical contact, high throughput sample screening is enabled by rapidly moving the secondary (sample) capillaries. rESI of ultra-low volume samples is also achieved down to sub pL as observed by an optical microscope and sub nL as observed by a linear ion trap. Regular polar analytes, including phosphopeptide, DNA oligonucleotides, illicit drugs, lipids, pharmaceutical compounds, and explosives are successfully ionized by rESI with sensitivities (LOD 0.5 ppb for cocaine) similar to normal nanoESI. Additionally, non-polar analytes (steroids, alkynes) are ionized by rESI using electrolytically generated metal cations from the primary electrospray.

Example 1: System Set-Up and Materials

The primary ion source was placed 1-10 mm from the secondary emitter. Typical voltages used for the primary electrospray were 1.0-3.5 kV. Typical values for the needle discharge plasma were 3-4.5 kV. The piezoelectric discharge gun (Zerostat) triggered by hand, was squeezed and released slowly. The spray plumes of the relay ESI emitters (and the primary ESI emitters when used) were recorded using a Watec camera (WAT-704R). The spray plumes were illuminated by a laser 405 nm laser. For the bundled arrays, the laser beam was defocused using an external lens to enlarge the illumination area. For ultra-low volume sampling, an optical microscope (Olympus BX-51) was used to monitor the spray ejection of the loaded sample solution. The ionic species generated by the relay ion source were recorded using a linear ion trap mass spectrometer LTQ (Thermo Scientific, CA). The instrument condition/parameters are described in Li et al. (Chem. Commun. 2011, 47, 2811-2813). When performing collision induced dissociation, an isolation window of 1.5 Th, a Mathieu qz value of 0.25, and a 20% normalized collision voltage were used.

The noble metal electrodes used for electrolytic spray ionization were previously described (Li et al., Angew. Chem., Int. Ed. 2014, 53, 3147-3150, incorporated by reference herein in its entirety). Borosilicate nanoESI and fused silica emitters were pulled using micropipette pullers (p-97 and P-2000, respectively, Sutter Instruments). Epoxy glue (Devcon) and a micro butane torch (Bernzomatic ST200T) were used to seal emitter openings when needed. Quartz emitters (PicoTip, New Objective, MA) were used directly as received. A 10 nm layer of metal Au/Pd film was sputter (SPI module) deposited onto the emitters when needed.

HPLC grade acetonitrile and methanol (Chromasolv, Sigma-Aldrich) were used as received. Deionized water (18.2 MΩ) was obtained from a Milli-Q Plus water purification system (Millipore, Bedford, Mass.).

Formic acid, cholesterol, Vitamin D3, and 3-octyne were purchased from (Sigma-Aldrich, MO). Cocaine standard solution (1000 ppm, Cerilliant Corp. TX) was serially diluted to the required concentrations. The phosphopeptide, Thr-Arg-Asp-Ile-pTyr-Glu-Thr-Asp-Tyr-Tyr-Arg-Lys ([$pTyr^{1146}$; SEQ ID NO.: 1] insulin receptor (1142-1153)) was purchased from Biomol (Enzolifesciences, NY) and used as received. DNA oligomers were supplied by Integrated DNA Technologies (Coraville, Iowa, USA).

The details for the high voltage source and the current measurement equipment used have been previously reported (Li et al., Angew. Chem., Int. Ed. 2014, 53, 3147-3150, incorporated by reference herein in its entirety). Briefly, a grounded plate (positioned ~1 cm away from the tip of the spray emitter) collects the ion current, which is converted to a voltage and monitored by an oscilloscope. A previously described wire-in nanoESI ion source (Li et al., Angew. Chem., Int. Ed. 2014, 53, 3147-3150, incorporated by reference herein in its entirety), a previously described needle discharge plasma ion source (Jjunju et al., Int. J. Mass Spectrom. 2013, 345-347, 80-88; and Li et al., J. Am. Soc. Mass Spectrom. 2013, 24, 1745-1754), and a handheld piezoelectric discharge gun (Zerostat3, Tedpella, Calif.) were used as primary ion sources.

A Teflon base was used to anchor the secondary emitters. An insulating membrane of 7.5 cm×7.5 cm with a 2 mm hole was mounted around the middle of the secondary emitter during current/MS analysis to avoid interference from the primary ions/charges. Regular arrays of secondary emitters were anchored 1 cm away from each other on the base. Bundled arrays were made by sticking several layers of closely packed emitters together using double sided tape. The secondary emitters were arranged into a bundle (~4 mm×6 mm) containing 11 emitters (4 bottom, 3 middle, 4 top) held together by double-sided tape between each layer. All the tips were approximately the same distance from the metal plate as the others. A grounded metal plate was placed approximately 25 mm from the ends of the emitters during spray visualization. The primary ion sources were placed 1-10 mm from the secondary emitters. Typical potentials used for primary electrospray were 1.0-3.5 kV. Typical values for the needle discharge plasma were 3-4.5 kV. Resistors of 1 GΩ and 0.1 GΩ were used for the primary electrospray and needle plasma discharge respectively to limit current. The piezoelectric discharge gun, triggered by hand, was squeezed and released slowly in approximately 1-5 second cycles depending on the needs of the experiment.

The images of the spray plumes of the relay ESI emitters (and the primary ESI emitters when used) were acquired using a Watec camera (WAT-704R) controlled by the MAGIX Video-easy TERRATEC Edition software package. In order to observe the spray plumes, the ends of the tips were illuminated by positioning a laser pointer (405 nm) at an angle of approximately 30° above the emitters and at a distance of ca. 25 mm. For the bundled arrays, this was measured from the end of the pointer to the middle of the bundle. The laser beam was defocused using an external lens attached to the end of the pointer to enlarge the illumination area so that all of tips in the bundle could be observed spraying in one video. For ultra-low volume sampling, an optical microscope (Olympus BX-51) was used to monitor the ejection of the loaded sample solution.

The ionic species generated by the ion sources were recorded using a linear ion trap mass spectrometer LTQ (Thermo Scientific, CA). The instrument condition/parameters are described in Li et al., (Chem. Commun. 2011, 47, 2811-2813). When performing collision induced dissociation, an isolation window of 1.5 Th, a Mathieu qz value of 0.25, and a 20% normalized collision voltage was used. In detection limit studies, automatic gain control (AGC) was turned off and injection time of 10 and 50 μs were used for full scan and MRM modes.

The commercially available piezoelectric discharge gun is comprised of piezoelectric crystals and a compression trigger. Streams of positive ions (followed by negative ions/electrons) were generated in a complete squeeze and release cycle. When the trigger is squeezed, positive ions are released. When the trigger is released, negative charges are created. The device is labeled as delivering approximately 1 Coulomb charge per cycle. When the gun was placed 5 cm away from a 5 cm diameter grounded plate, ~10 μA currents could be measured when slowly triggering the device.

Example 2: Sample Analysis Using Systems of the Invention

Figure 3:
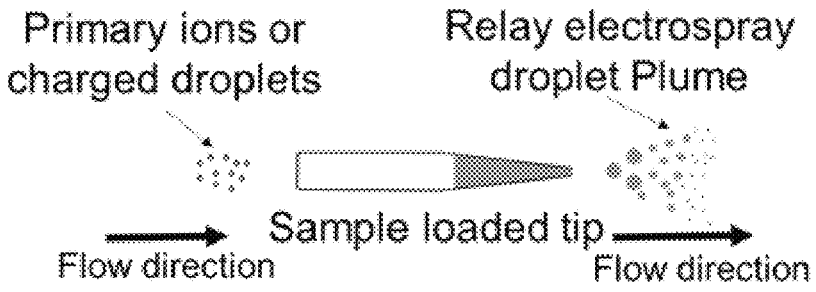
FIG. 3 shows an exemplary scheme for sample analysis using systems and methods of the invention. Charge is supplied into (open configuration) or onto the outside (closed configuration) of the sample capillary as ions or charged droplets from a primary source (needle discharge plasma, piezoelectric discharge plasma or electrospray ion source). The relay generates ions from the analyte solution for mass spectrometric analysis.

The Example herein shows a relay technique (rESI), performed by depositing charge (ions) onto or into an ESI emitter loaded with sample solution. The impinging ions, generated by a primary electrospray or plasma ionization source, pass charge to the electrically floated sample loading capillary, causing an immediate electrospray to occur from the tip of the secondary capillary (FIG. 3).

Figure 4:
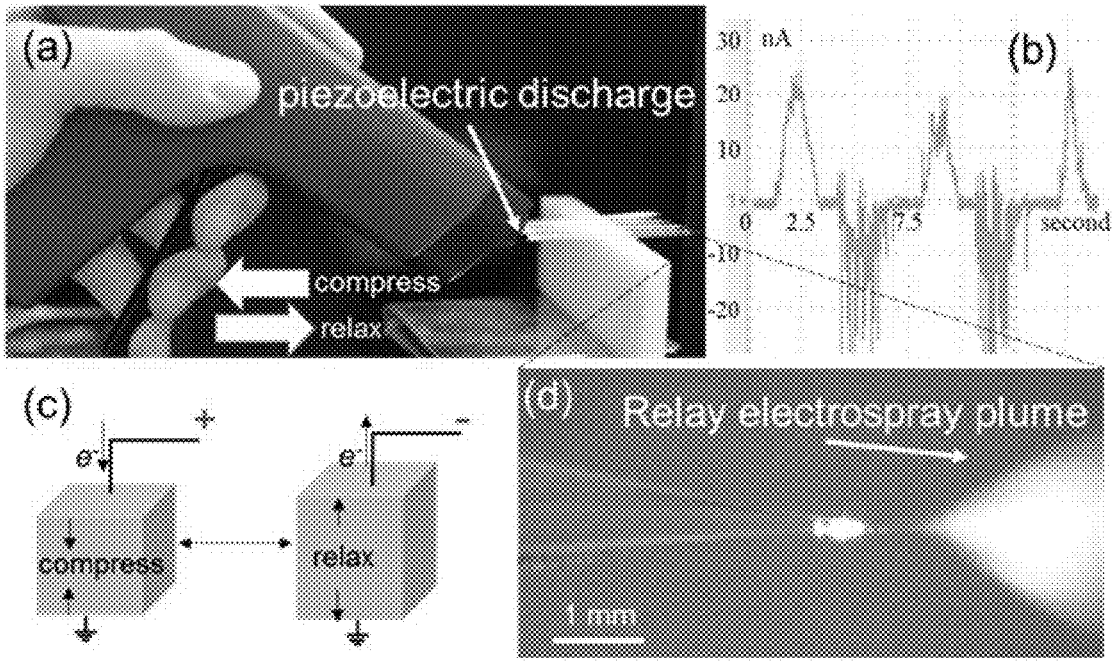
FIG. 4 panel A shows a photograph of set-up of a handheld piezoelectric direct discharge plasma generator as primary ion source in relay ESI.
Figure 5:
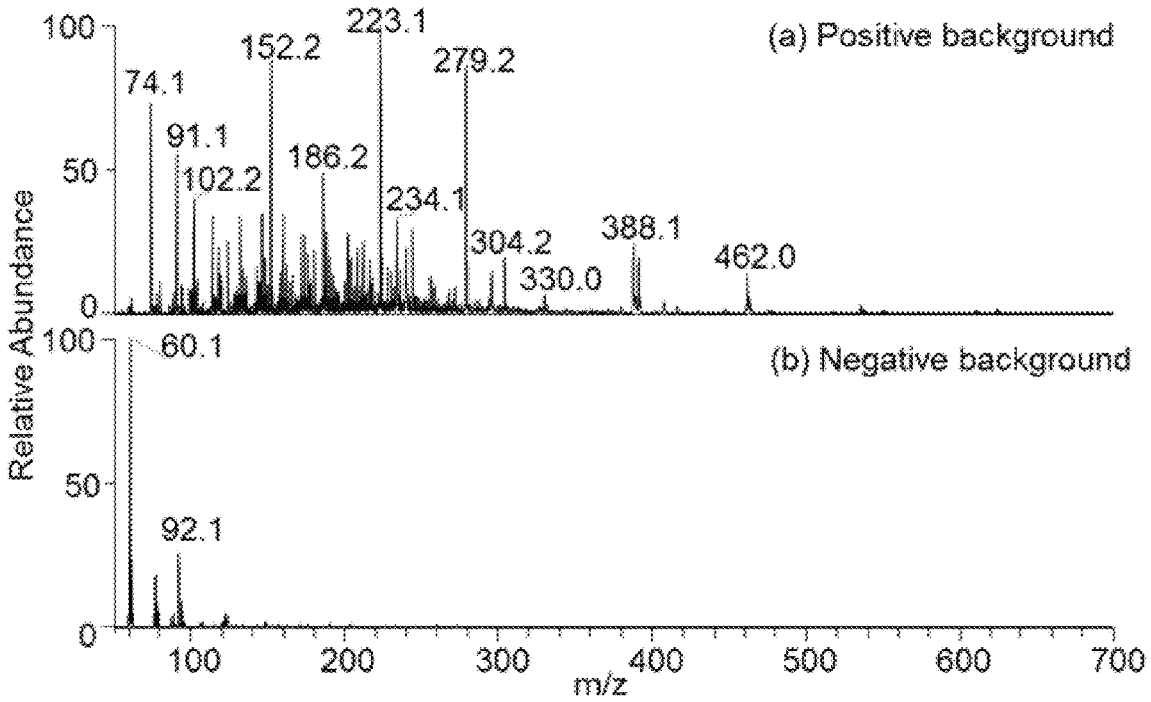
FIG. 5 panels A-B are mass spectra showing background ions generated by the piezoelectric discharge plasma in positive (FIG. 5 panels A) and negative (FIG. 5 panels B) modes in a lab environment. The discharge plasma was placed 30 cm away from the mass spectrometer inlet. The absolute intensity (normalized level) for (a) and (b) were $1.1\times10^4$ and $5.2\times10^4$ respectively.
Figure 6A:
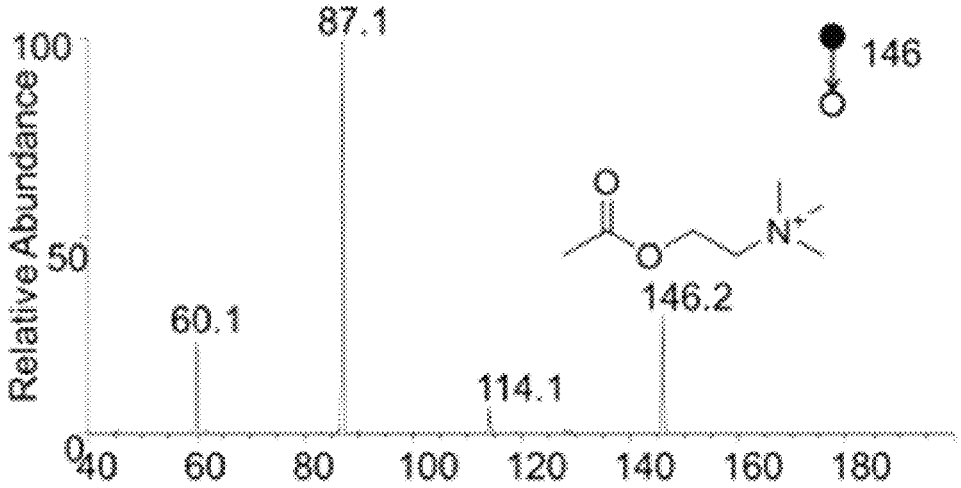
FIG. 6A shows relay electrospray MS analysis of ca. 1 pL of 0.5 ppb acetylcholine, MS/MS of m/z 146, This single scan data is taken using a 50 ms injection time window. The whole experiment (dip and spray) takes less than 30 s on a total sample size of 2,000 molecules.
Figure 6B:
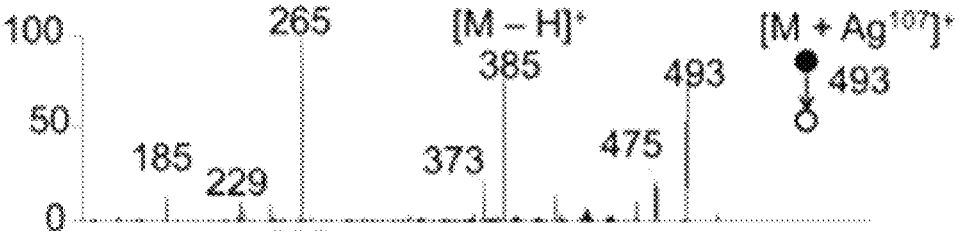
FIGS. 6B-C show relay electrospray MS analysis of 100 ppb cholesterol, MS/MS of isotopic $[M+Ag]^+$ ions. Silver ions from a primary electrolytic ionization source were used to cationize the analyte.
Figure 6C:
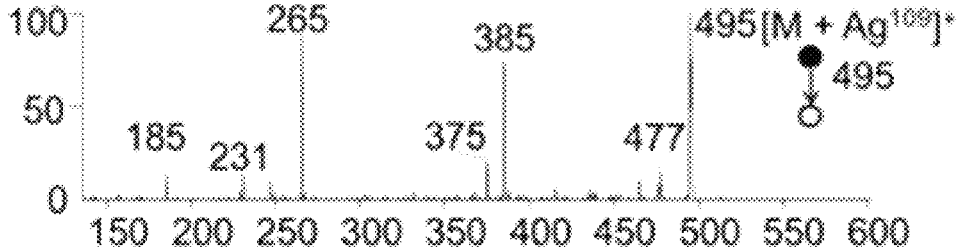
Figure 6D:
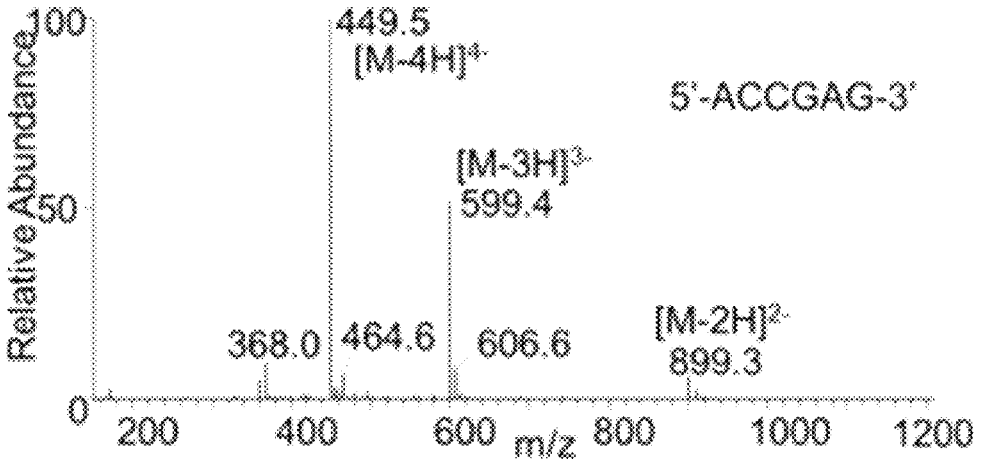
FIG. 6D show relay electrospray MS analysis of 1 μM DNA oligomer in negative ion mode.
Figure 6E:
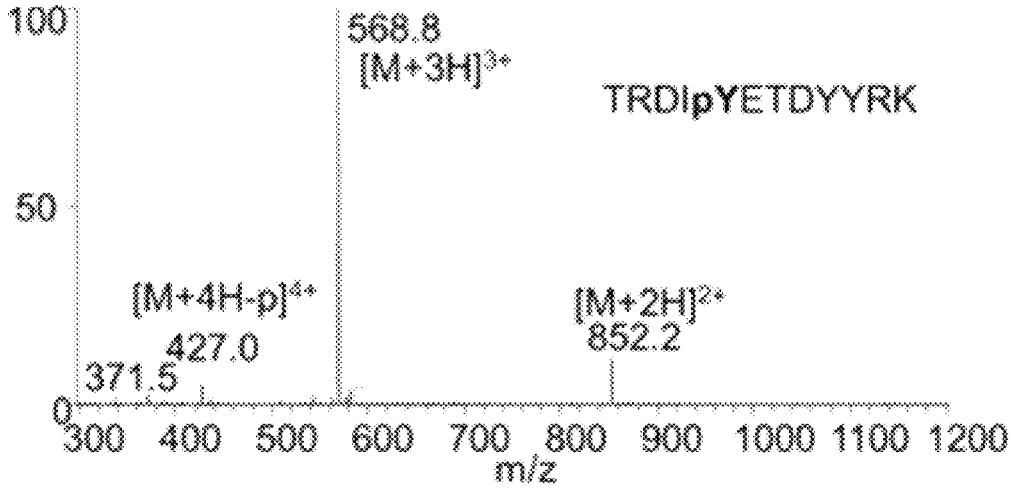
FIG. 6E show relay electrospray MS analysis of 1 μM DNA oligomer in positive ion mode.
Figure 7:
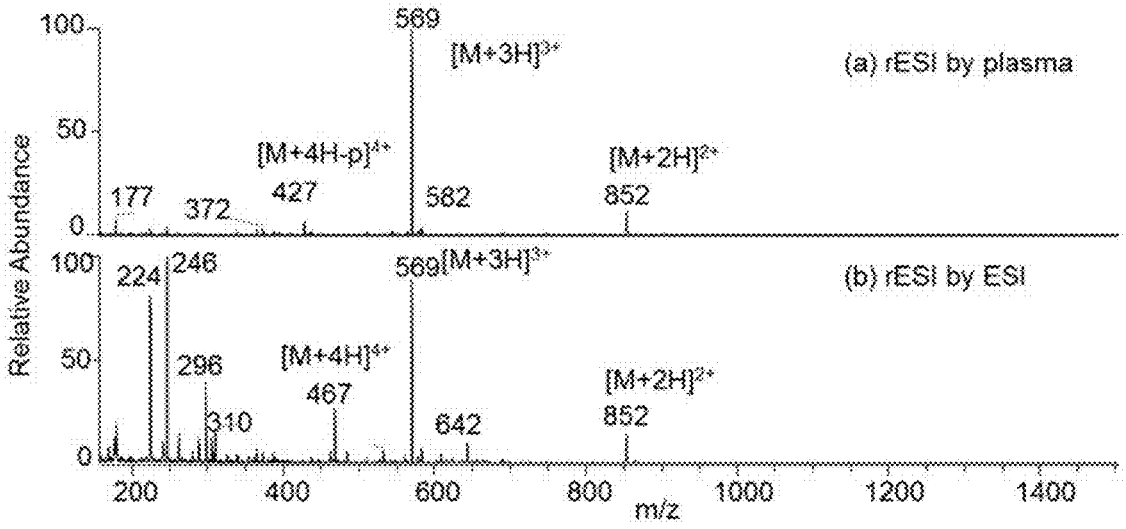
FIG. 7 panels A-B show that when using a piezoelectric plasma discharge as a primary ion source in a relay experiment run in with an open secondary capillary, a small degree of dephosphorylation was observed for the highly charged phosphopeptide ion $[M+4H-p]^{4+}$ as compared to the native forms observed by ESI or conventional nanoESI. The absolute intensity (normalized level) for (FIG. 7 panel A) and (FIG. 7 panel B) were $1.1\times10^3$ and $1.5\times10^3$ respectively.

Using a hand-held piezoelectric direct discharge plasma generator as a primary ion source, rESI ion signal was generated (FIG. 4 panels A-D). In one triggering-releasing cycle, the piezoelectric direct discharge plasma generates cations and anions/electrons consecutively. (FIG. 5). The triggered relay ESI has corresponding positive and negative ion currents of 10-20 nA in typical experiments. Various analytes of interest, including acetylcholine, cholesterol, phosphopeptides, and DNA oligomers were successfully ionized in both the open and closed configurations (FIGS. 6A-E) Even in the open mode, the impinging plasma ions do not degrade the analytes in most samples tested, except for phosphopeptide where a small amount of dephosphorylation was observed (FIG. 6D and FIG. 7 panels A-B). Solutions of acetylcholine (0.1 ppb) analyzed by rESI using multiple reaction monitoring (MRM) gave signals 10 times that of the blank solution. Although a needle discharge plasma source produces constant rESI currents over a longer time, for most rESI analyses, the 2-5 s piezoelectric discharge triggering is adequate, portable and free of safety concerns.

Figure 8:
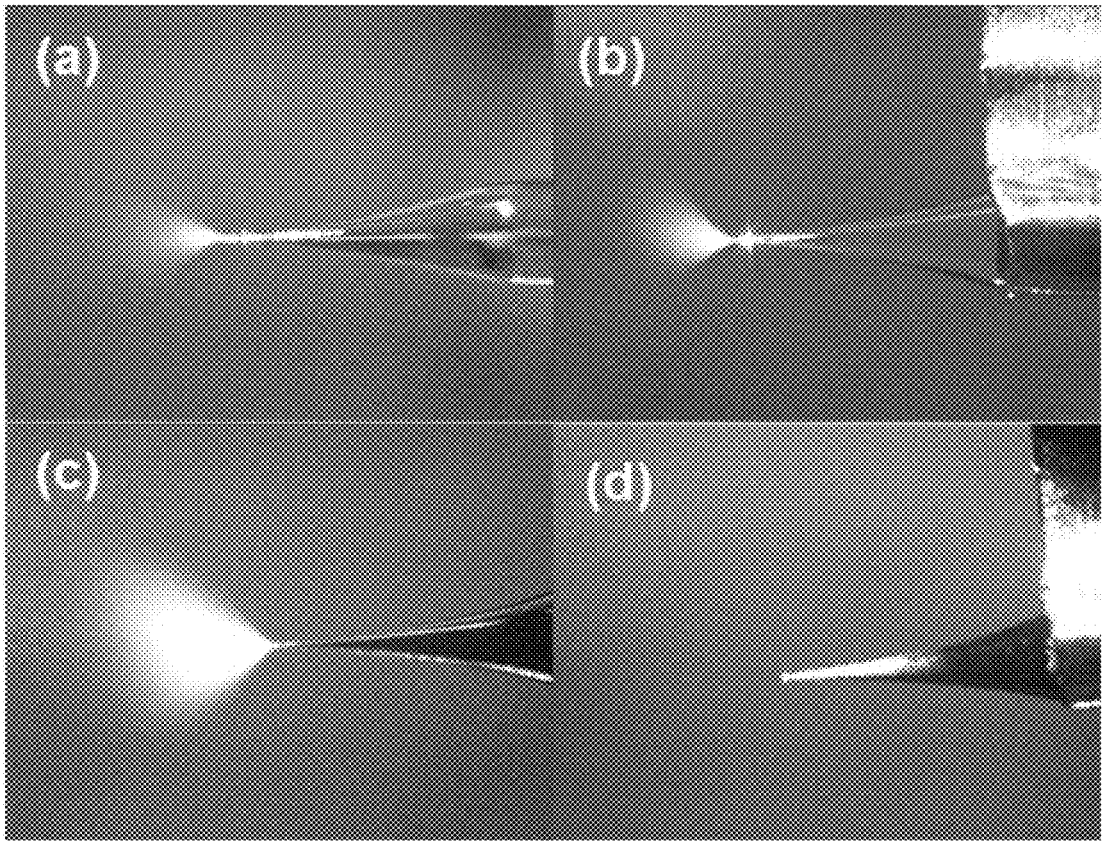
FIG. 8 panel A is a photograph showing that relay electrosprays could be generated from the distal end of capillaries sealed at the proximal end.
Figure 9:
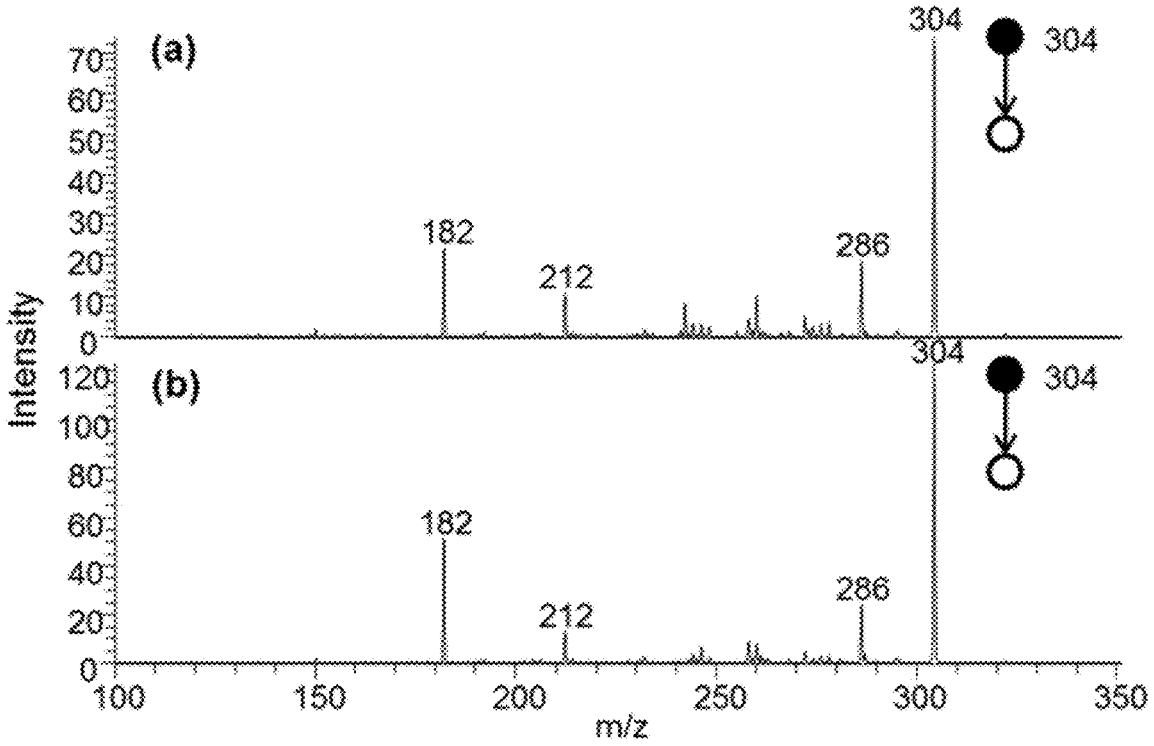
FIG. 9 panels A-B show MRM intensity (absolute intensity on y axis) from the same (1 ppb) cocaine solution from the same secondary emitter (FIG. 9 panel A) after and (FIG. 9 panel B) before sealing the proximal end. Comparison of the data indicates a 40% decrease in signal after sealing the end.
Figure 10:
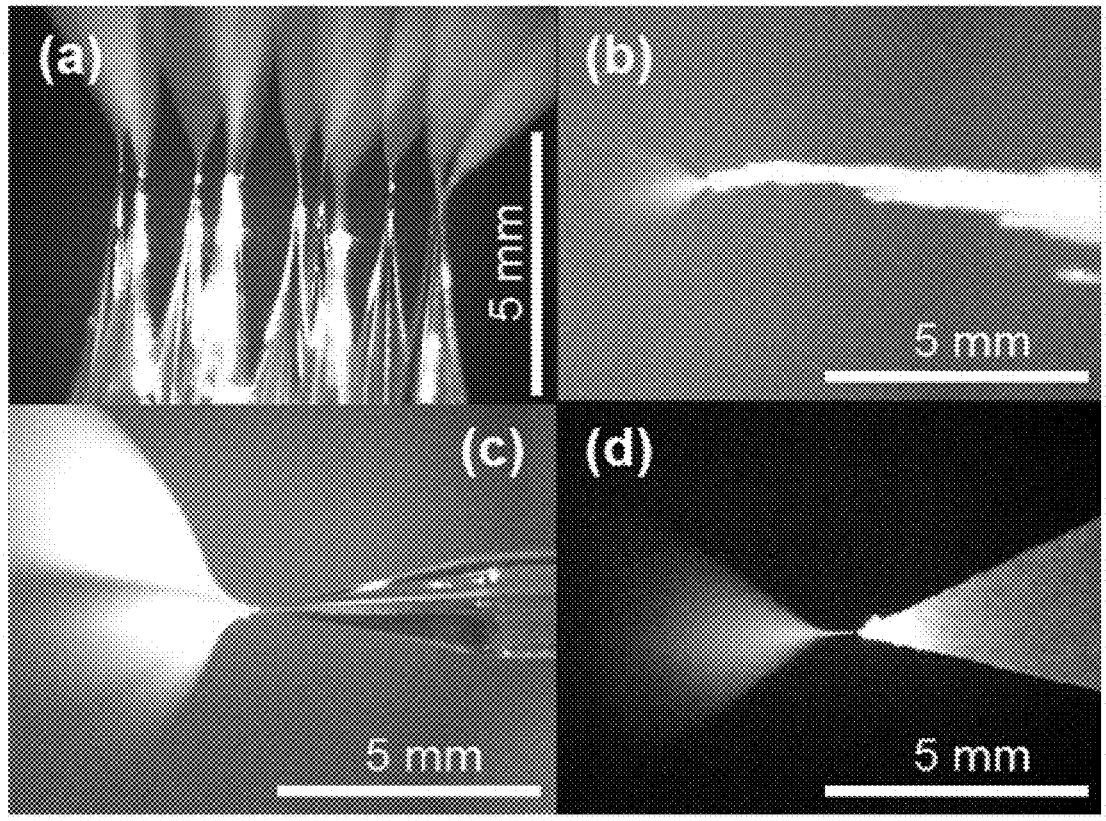
FIG. 10 panels A-D are photographs showing relay spray from several different emitters, (FIG. 10 panel A) buddle array of 11 nanoESI emitters.

When the proximal end of the secondary emitter is sealed either with epoxy or by melting the glass, rESI emission is still generated when triggered by a primary ion source (FIG. 8 panels A-C). MRM analysis revealed a 40% decrease in signal intensity when compared with the results from an open emitter (FIG. 9 panels A-B). However, rESI can only be avoided altogether when the entire secondary capillary is grounded (e.g. by sputter coating a layer of Pd/Au; FIG. 8 panel D). This suggests that charge accumulation in the sample solution or on the outside of the glass capillary will lead to relay electrospray, corresponding to the inside contact and outside contact (via a coated gold layer) configurations of conventional ESI. The rESI phenomenon occurs with all the types of emitters tested, including capillaries of borosilicate, quartz, or fused silica, steel needles, theta shaped capillaries, and those made of porous materials like wooden tips and paper. The on-demand spray from a paper substrate represents an alternative way of performing paper spray ionization. Bundled (close-packed) emitter arrays also demonstrate rESI, allowing for high throughput screening and scaled-up ion soft landing experiments (FIG. 10 panels A-D).

Figure 11:
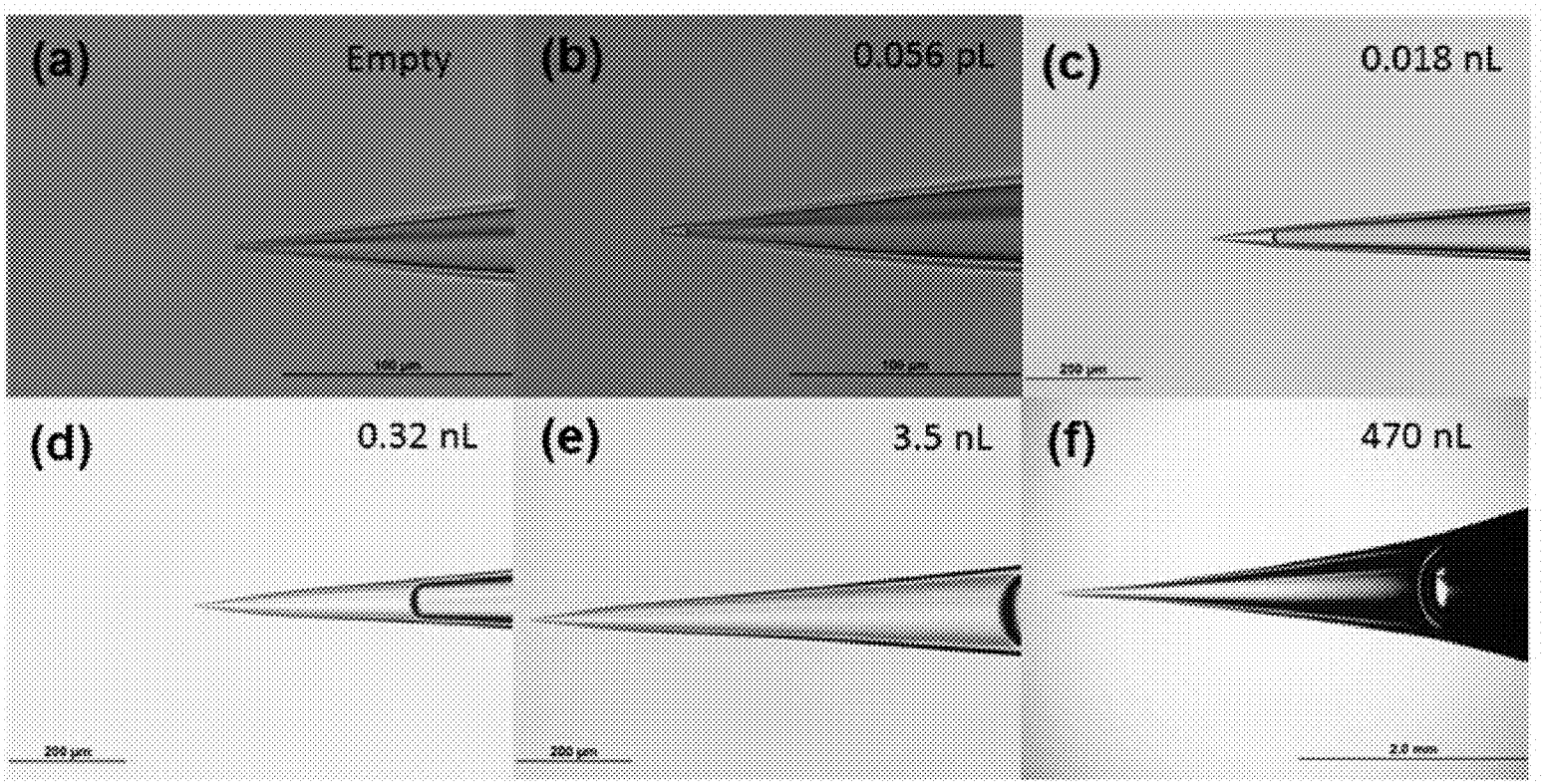
FIG. 11 panels A-F are photographs showing that ultra-low volume (from sub picoliters to microliters) sample solution (to the left of the meniscus) was loaded into the sharp tip of the relay capillary. Relay electrospray phenomenon was observed for all of these loaded tips.
Figure 12:
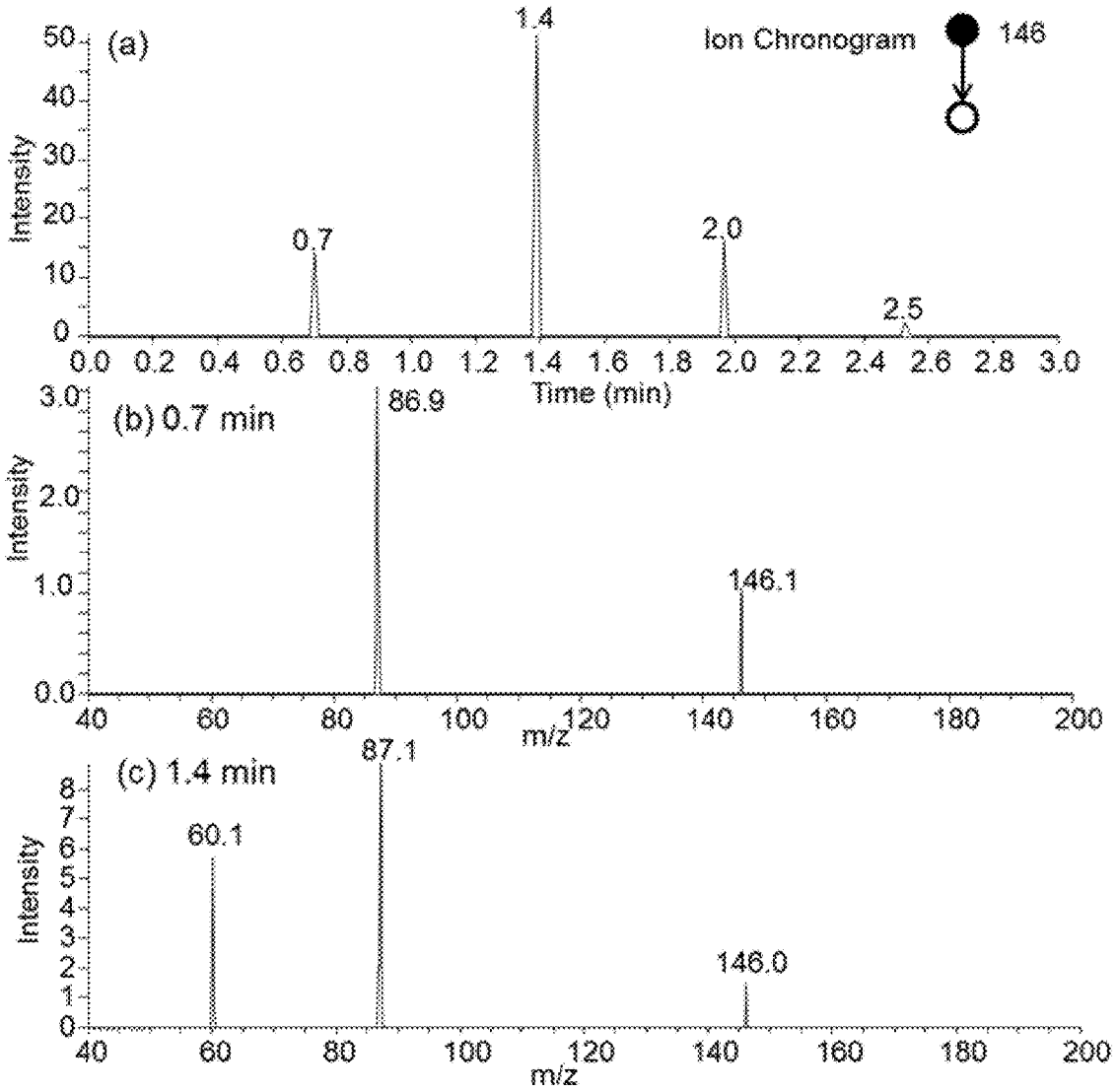
FIG. 12 panels A-C show MS/MS obtained from rESI of ~1 pL of a 0.5 ppb acetylcholine solution (estimated as 0.5 attogram, 3 zmol, 2,000 molecules) loaded into a capillary and analyzed by rESI. Four separate experiments were done as shown in the total ion count showing the repeatability and deviations in the data.

The rESI emitters can be used as micro aspiration tools. Due to the requirement of electrical contact, conventional ESI emitters are usually loaded using LC pumps or centrifugation from their wider end. Using sealed capillary emitters, thermal expansion of air can be used to aspirate solution volumes in the range pL to μL by capillary action. Ultra-low sample volumes (from 50 fL up to several to μL) were achieved (FIG. 11 panels A-F). Zero dead volume rESI is demonstrated by electrospraying all of the solution from a capillary. Volumes of ~1 pL (0.5 ppb, ~0.5 attogram, ca. 2,000 molecules) of acetylcholine produced reliable ion signals observable using an linear ion trap mass spectrometer (FIG. 12 panels A-C). Finally, the application of a flame to the sharp tip can seal the emitter, transforming the emitter into a micro vessel for sample storage.

Figure 13:
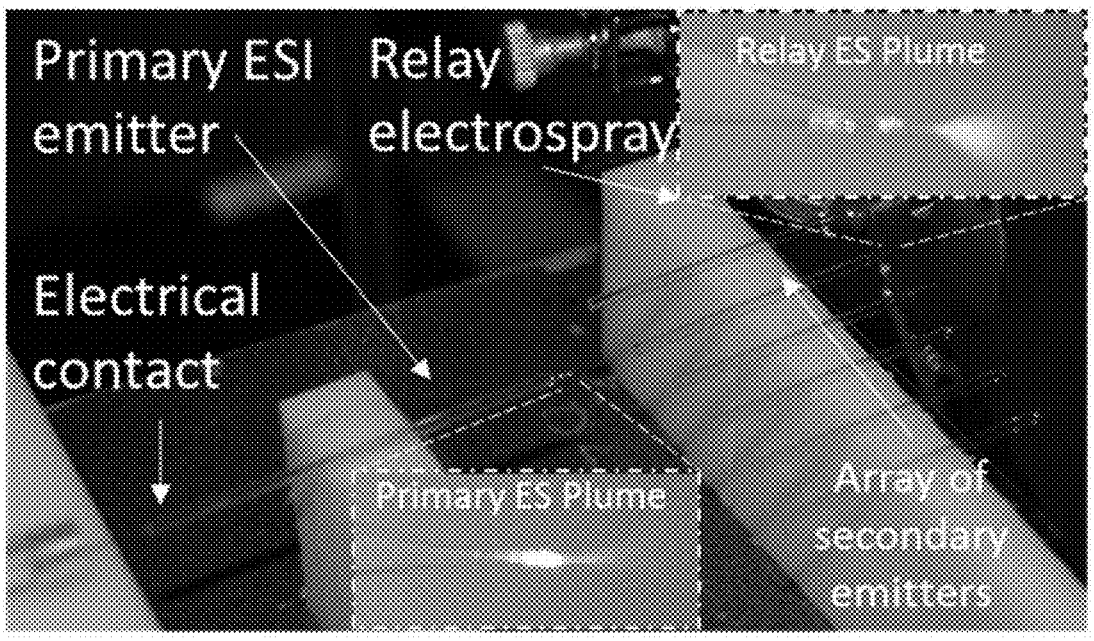
FIG. 13 is a photograph showing that using a regular wire-in nanoelectrospray emitter as the primary ion source, a spray plume from the sample loading relay (secondary) tip was captured by camera under illumination. In a typical experiment, stable ion currents of 8-10 nA were generated by the relay (secondary) tip when the primary ESI emitter was operated at 12 nA. (Shielding mask is not shown in this figure.)
Figure 14:
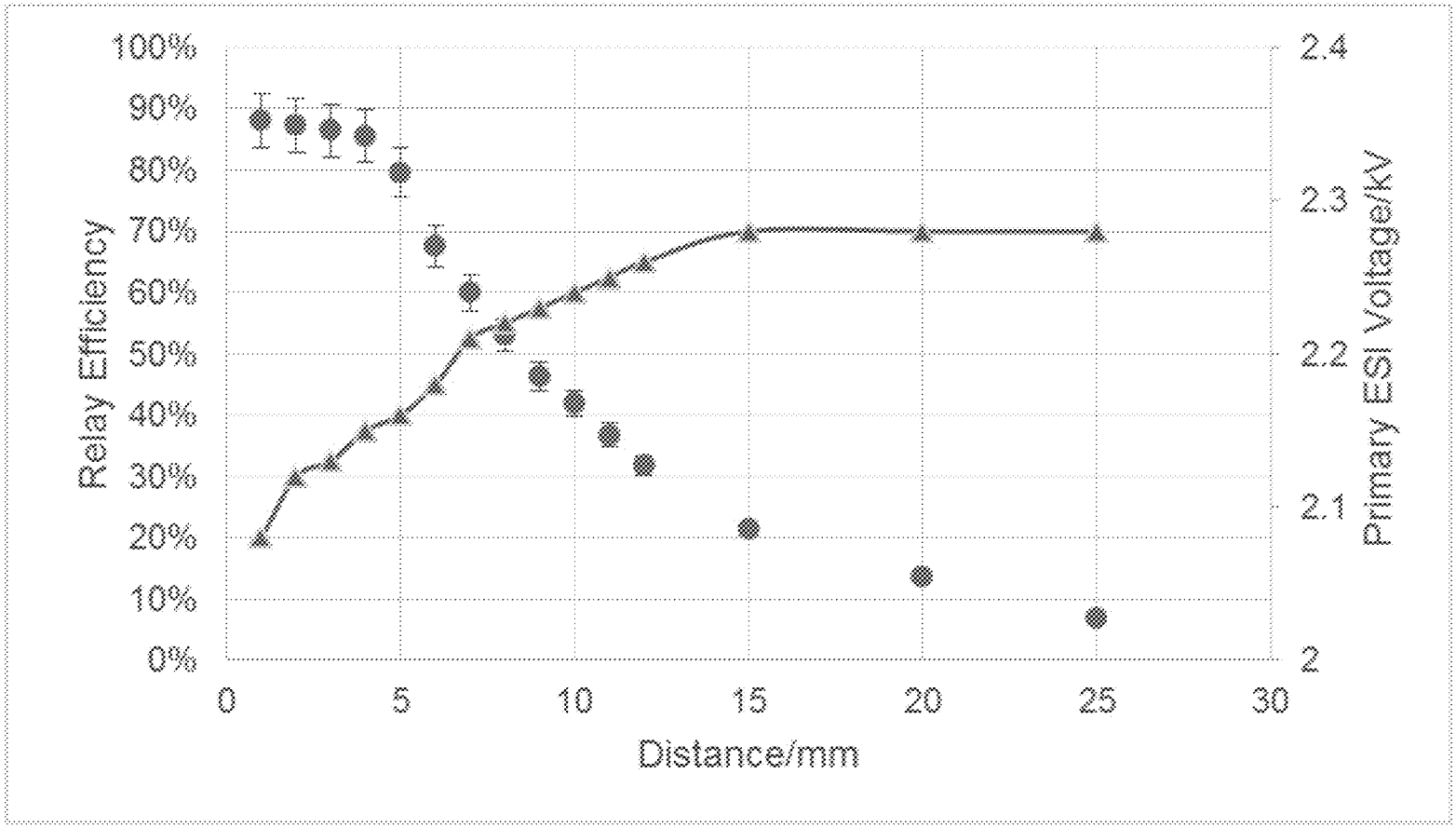
FIG. 14 is a graph showing ESI-ESI relay efficiency and primary voltage vs. emitter to emitter distance, the primary ESI current was held at 12 nA by adjusting the applied voltage (triangles), the current from the secondary (relay) ESI is presented as a percentage of the primary current (dots) for different distances (primary tip end to secondary proximal end) between the two emitters.
Figure 15:
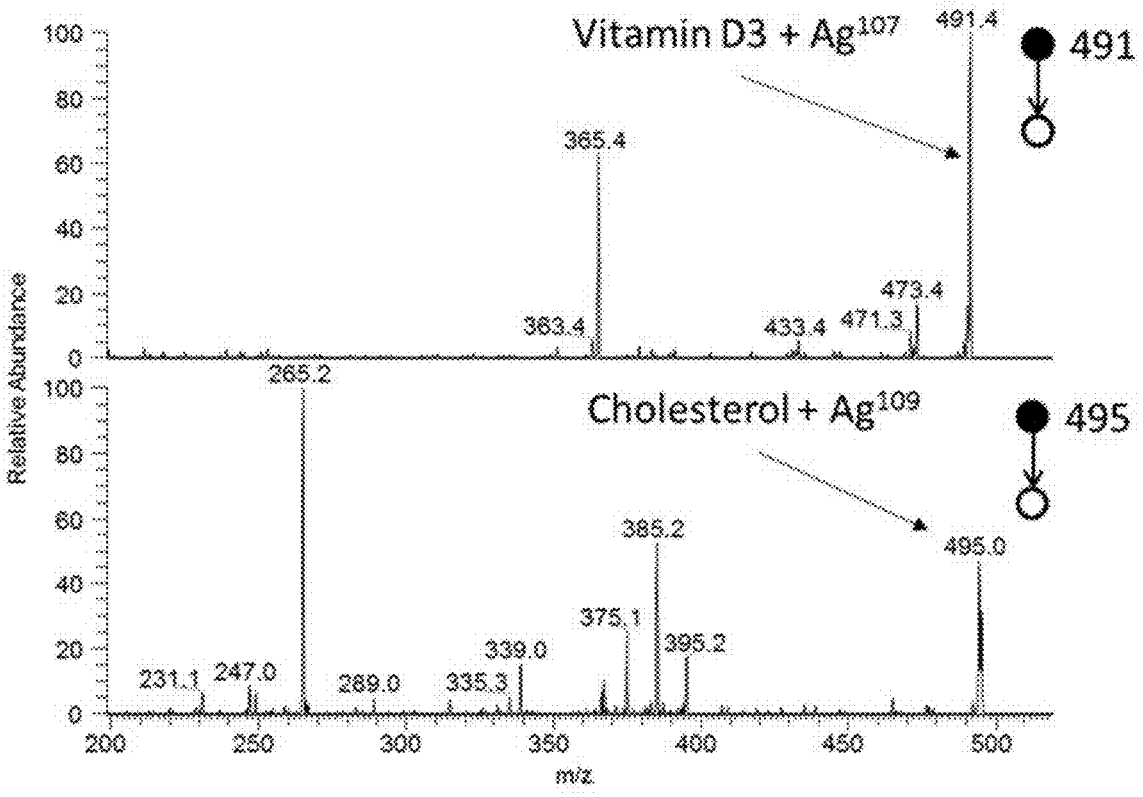
FIG. 15 are mass spectra showing product ion MS/MS using CID of silver cationized cholesterol (MW=386) and vitamin D3 (MW=384). The silver cations were generated in the primary ion source using electrolytic spray under aprotic conditions. Using selecting different silver isotopes in vitamin D3 ($M+Ag^{107}$) and cholesterol ($M+Ag^{109}$), a larger mass difference than would otherwise be achieved by conventional methods (protonation, sodium adduct, etc.) is used to eliminate any isotopic crosstalk between the two analytes during isolation and fragmentation, allowing simultaneous MRM analysis.
Figure 16:
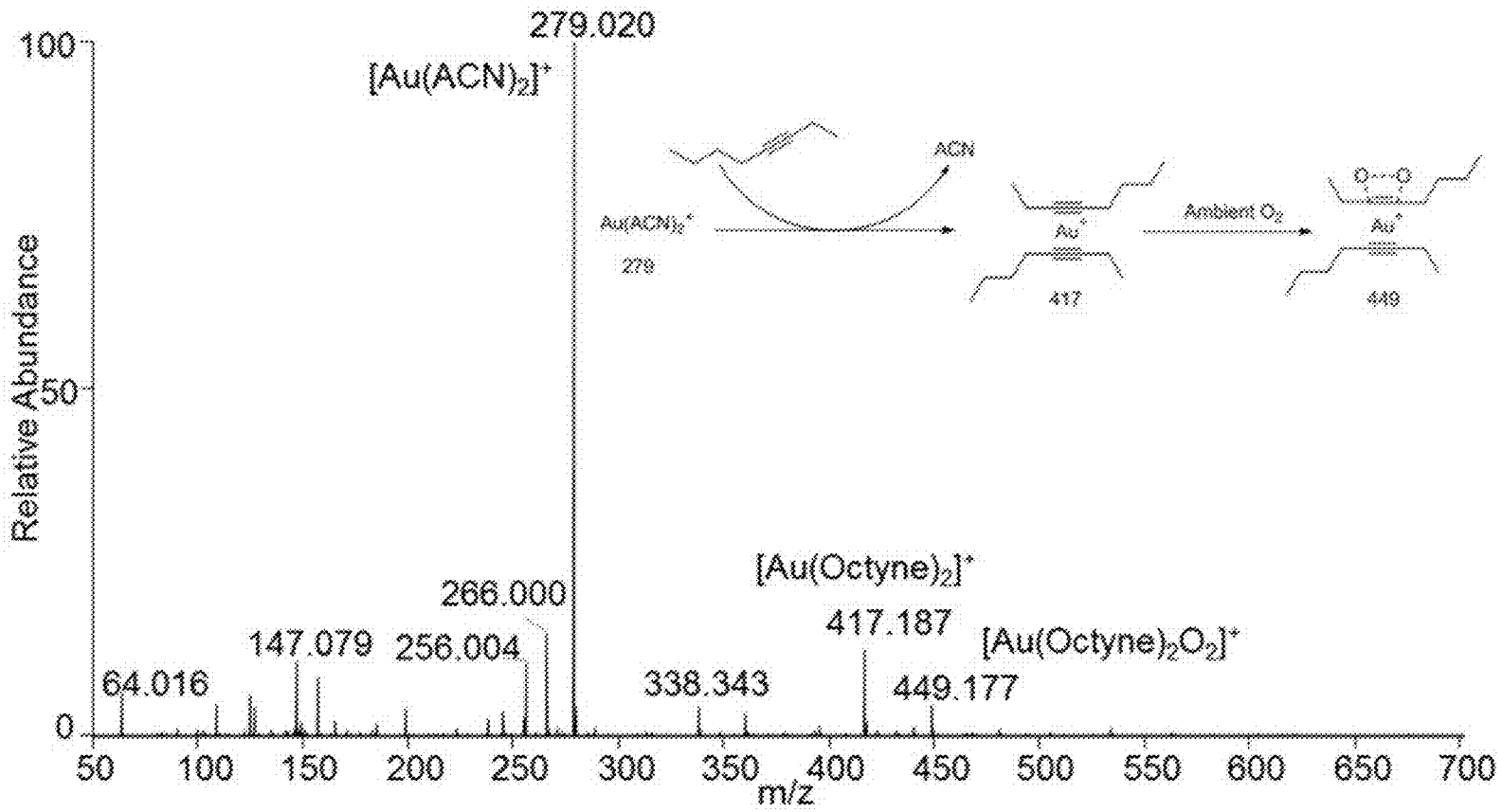
FIG. 16 is a mass spectrum showing $Au^+$ generated from electrolytic ionization of gold wire in the primary ESI source and deposited onto an alkyne (3-octyne, 100 ppbv in acetonitrile) in the secondary emitter allowed ionization by $Au^+$ clustering, (m/z 417). High resolution MS confirmed the peak assignments. For the labeled peaks mass errors are all positive and smaller than 5 ppm.

In a typical relay experiment stable ion currents of 10 nA were generated by the relay (secondary) tip when using a 12 nA primary ESI emitter current to generate primary charged droplets (FIG. 13). This corresponds to ~80% current transmission efficiency (FIG. 14). Because it is Isolated from the sample solutions, the primary electrospray ionization source also provides opportunities for versatile chemistries. As one example, noble metal ions from electrolytic spray ionization of silver and gold in the primary ion source were used as cationization reagents for the soft ionization of olefins and alkynes in steroids, vitamin D3, and 3-octyne. (FIG. 6D and FIGS. 15-16).

Figure 17:
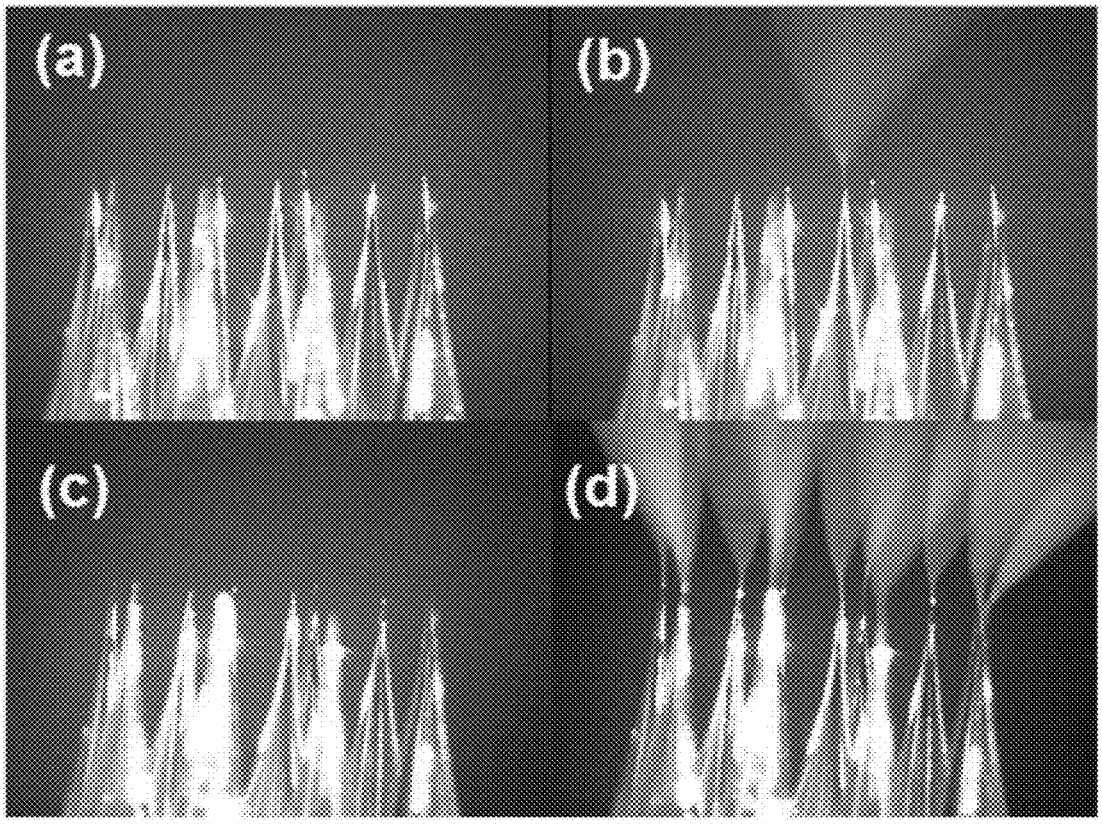
FIG. 17 panels A-B show array of emitters (FIG. 17 panel A) before and (FIG. 17 panel B) upon selective triggering of one channel.
Figure 18:
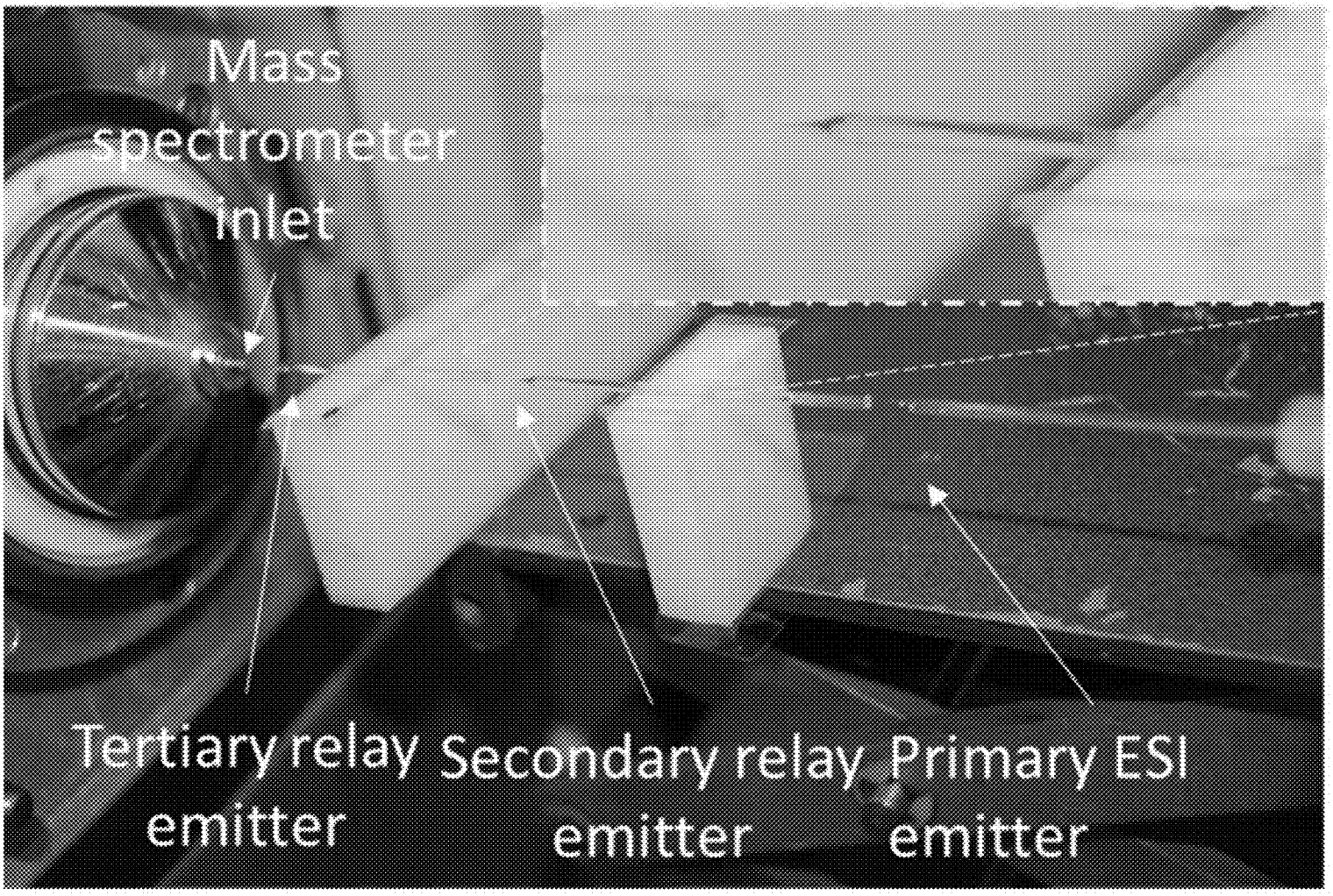
FIG. 18 is a photograph showing triple serial electrospray relay of as a demonstration of multiple stage capability. This configuration has an overall current transmission efficiency of 36%. Similarly, quadruple serial relays were constructed using a needle plasma discharge as primary ion source, with overall current transmission efficiency of only 4%.

Selective and sequential activation of elements in arrays of emitters, as well as multiple stage serial relay electrosprays, has also been demonstrated (FIG. 17 panels A-D and FIG. 18). All these capabilities associated with rESI allow for portable, high throughput biochemical analysis systems and performance of small volume reactions and reaction intermediate studies. Recent interest in ultra-microscale chemical reactions, including experiments in which arrays of drug candidates are tested against biological substrates and the products analyzed in high-throughput fashion is also accomplished using systems and methods of the invention. Certainly, the ability to measure mass spectra from samples consisting of several thousand molecules will advance these objectives as well as other low level measurements including single cell mass spectrometry.

Example 3: Micro Aspiration of Ultra-Low Volume Samples and rESI Analysis

Nanospray emitters, picospray tips and nanopipettes are conventionally loaded from the larger side of the emitter and solution is pneumatically transferred to the tip with the help of the LC pump or even centrifugation. These types of operation are incapable of accurately loading small volumes of sample solution into the emitter. Using a sealed capillary with only one opening, samples can be loaded from the sharp tip. Simply by dipping the sharp tip into the sample solution, capillary action aspirates solution in amounts usually no more than 1 nL, (FIG. 11 panels A-F) the limit being set by pressure build up inside of the sealed emitter. By preheating the emitter to a fixed temperature before sample loading the cooling of the emitter creates a partial vacuum which aspirates a fixed volume of sample solution into the emitter. With a 30 μL tip and preheating from room temperature to 80° C., volumes up to ~5 μL can be drawn into the emitter.

Example 4: Electrospray Ionization as the Primary Ion Source: Parallel and Serial Arrays As shown in FIG. 13, relay ESI can also be triggered by using a primary ESI source. Compared to the discharge plasmas, the primary currents from the primary ESI sources were usually lower and rESI was established with somewhat lower currents but with much higher stability. Current transmission efficiency of the relay ESI is increased by reducing the distance between the primary emitter tip and the proximal meniscus in the relay emitter. This can also be achieved using wicking fibers, conductive fibers, or a conductive coating on the walls of the relay emitter. The fact that the primary ESI source is isolated from the secondary makes it easy when using the open configuration to supply metal cations to analytes to create selective product ions. Controllable parallel triggering of emitter arrays was demonstrated with relay ESI. In addition, serial (triple and quadruple) relay ESI was demonstrated.

What is claimed is:

1. A system for analyzing a sample, the system comprising:

a plurality of emitters, in which a first emitter relays ions onto a second emitter to produce an electrospray of a sample from the second emitter, wherein the first and second emitters are not in physical contact with each other, wherein the second emitter is a hollow body and the sample is held within the hollow body, wherein the second emitter is selected from the group consisting of: a hollow capillary in which a proximal and distal end are open; a hollow capillary in which a proximal end is sealed and a distal end is open; a steel needle comprising an inner bore; and a mass spectrometer positioned to receive the electrosprayed sample.

2. The system according to claim 1, wherein a proximal portion of the hollow body is open ended and the ions from the ion source are directed to interact with and enter a proximal end of the hollow body, thereby causing the sample to be discharged from a distal end of the second emitter and into the mass spectrometer.

3. The system according to claim 1, wherein a proximal portion of the hollow body is sealed and the ions from the ion source are directed to interact with the proximal end of the hollow body, thereby causing the sample to be discharged from a distal end of the second emitter and into the mass spectrometer.

4. The system according to claim 1, wherein the first emitter is an electrospray source.

5. The system according to claim 1, wherein the first emitter is an plasma discharge source.

6. The system according to claim 1, wherein the mass spectrometer is a bench-top or miniature mass spectrometer.

7. A method for analyzing a sample, the method comprising:

generating ions from a first emitter;

directing the ions to interact with a second emitter comprising a sample in order to cause the sample to be discharged from the second emitter, wherein the first and second emitters are not in physical contact with each other, wherein the second emitter is a hollow body and the sample is held within the hollow body, wherein the second emitter is selected from the group consisting of: a hollow capillary in which a proximal and distal end are open; a hollow capillary in which a proximal end is sealed and a distal end is open; a steel needle comprising an inner bore; and analyzing the discharged sample in a mass spectrometer.

8. The method according to claim 7, wherein a proximal portion of the hollow body is open ended and the ions from the ion source are directed to interact with and enter a proximal end of the hollow body, thereby causing the sample to be discharged from a distal end of the second emitter and into the mass spectrometer.

9. The method according to claim 7, wherein a proximal portion of the hollow body is sealed and the ions from the ion source are directed to interact with the proximal end of the hollow body, thereby causing the sample to be discharged from a distal end of the second emitter and into the mass spectrometer.

10. The method according to claim 7, wherein the first emitter is an electrospray source.

11. The method according to claim 7, wherein the first emitter is an plasma discharge source.

12. The method according to claim 7, wherein the sample is a biological sample.

* * * * *